US007710357B2

(12) United States Patent
Itakura

(10) Patent No.: US 7,710,357 B2
(45) Date of Patent: May 4, 2010

(54) METHOD FOR DRIVING PLASMA DISPLAY PANEL

(75) Inventor: Shunsuke Itakura, Chuo (JP)

(73) Assignee: Panasonic Corporation, Osaka (JP)

( * ) Notice: Subject to any disclaimer, the term of this patent is extended or adjusted under 35 U.S.C. 154(b) by 391 days.

(21) Appl. No.: 11/905,041

(22) Filed: Sep. 27, 2007

(65) Prior Publication Data

US 2008/0079709 A1 Apr. 3, 2008

(30) Foreign Application Priority Data

Sep. 29, 2006 (JP) ..... 2006-268145

(51) Int. Cl.
*G09G 3/28* (2006.01)

(52) U.S. Cl. ..... 345/60; 345/67; 345/68; 345/214

(58) Field of Classification Search ..... 345/37–42, 345/55, 60–68; 315/169.1–169.4
See application file for complete search history.

(56) References Cited

U.S. PATENT DOCUMENTS 6,097,358 A * 8/2000 Hirakawa et al. ..... 345/63
6,144,364 A * 11/2000 Otobe et al. ..... 345/691
6,614,413 B2 * 9/2003 Tokunaga et al. ..... 345/63
6,724,356 B1 * 4/2004 Kojima et al. ..... 345/60
7,511,685 B2 * 3/2009 Kim et al. ..... 345/60
2007/0024533 A1 * 2/2007 Chae ..... 345/63

FOREIGN PATENT DOCUMENTS

JP 7-134565 5/1995

* cited by examiner

*Primary Examiner*—Richard Hjerpe
*Assistant Examiner*—Mansour M Said
(74) *Attorney, Agent, or Firm*—Drinker Biddle & Reath LLP

(57) ABSTRACT

A method for driving a plasma display panel that can generate stable and reliable discharge without making the circuit configuration of the driver complicated. According to this drive method, a plasma display panel where a pixel cell is formed at each intersection of a plurality of column electrodes and a plurality of row electrode pairs is driven such that, in a sustain process of at least one subfield out of subfields in one field display period, an auxiliary discharge is generated along with the sustain discharge in the pixel cell by applying an auxiliary pulse to the column electrode only while a first sustain pulse is being applied.

22 Claims, 12 Drawing Sheets

FIG. 6

| GRAYSCALE DRIVING | DATA CONVERSION TABLE | | | | | | | | | | | | | | | EMISSION PATTERN | | | | | | | | | | | | | | DISPLAY BRIGHTNESS |
|---|---|---|---|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| FIRST | 0000 | 0 | 0 | 0 | 0 | 0 | 0 | 0 | 0 | 0 | 0 | 0 | 0 | 0 | 0 | | | | | | | | | | | | | | | 0 |
| SECOND | 0001 | 1 | 1 | 0 | 0 | 0 | 0 | 0 | 0 | 0 | 0 | 0 | 0 | 0 | 0 | ◎ | ● | | | | | | | | | | | | | 1 |
| THIRD | 0010 | 1 | 0 | 1 | 0 | 0 | 0 | 0 | 0 | 0 | 0 | 0 | 0 | 0 | 0 | ◎ | ○ | ● | | | | | | | | | | | | 3 |
| FOURTH | 0011 | 1 | 0 | 0 | 1 | 0 | 0 | 0 | 0 | 0 | 0 | 0 | 0 | 0 | 0 | ◎ | ○ | ○ | ● | | | | | | | | | | | 9 |
| FIFTH | 0100 | 1 | 0 | 0 | 0 | 1 | 0 | 0 | 0 | 0 | 0 | 0 | 0 | 0 | 0 | ◎ | ○ | ○ | ○ | ● | | | | | | | | | | 17 |
| SIXTH | 0101 | 1 | 0 | 0 | 0 | 0 | 1 | 0 | 0 | 0 | 0 | 0 | 0 | 0 | 0 | ◎ | ○ | ○ | ○ | ○ | ● | | | | | | | | | 27 |
| SEVENTH | 0110 | 1 | 0 | 0 | 0 | 0 | 0 | 1 | 0 | 0 | 0 | 0 | 0 | 0 | 0 | ◎ | ○ | ○ | ○ | ○ | ○ | ● | | | | | | | | 39 |
| EIGHTH | 0111 | 1 | 0 | 0 | 0 | 0 | 0 | 0 | 1 | 0 | 0 | 0 | 0 | 0 | 0 | ◎ | ○ | ○ | ○ | ○ | ○ | ○ | ● | | | | | | | 55 |
| NINTH | 1000 | 1 | 0 | 0 | 0 | 0 | 0 | 0 | 0 | 1 | 0 | 0 | 0 | 0 | 0 | ◎ | ○ | ○ | ○ | ○ | ○ | ○ | ○ | ● | | | | | | 73 |
| TENTH | 1001 | 1 | 0 | 0 | 0 | 0 | 0 | 0 | 0 | 0 | 1 | 0 | 0 | 0 | 0 | ◎ | ○ | ○ | ○ | ○ | ○ | ○ | ○ | ○ | ● | | | | | 95 |
| ELEVENTH | 1010 | 1 | 0 | 0 | 0 | 0 | 0 | 0 | 0 | 0 | 0 | 1 | 0 | 0 | 0 | ◎ | ○ | ○ | ○ | ○ | ○ | ○ | ○ | ○ | ○ | ● | | | | 119 |
| TWELFTH | 1011 | 1 | 0 | 0 | 0 | 0 | 0 | 0 | 0 | 0 | 0 | 0 | 1 | 0 | 0 | ◎ | ○ | ○ | ○ | ○ | ○ | ○ | ○ | ○ | ○ | ○ | ● | | | 147 |
| THIRTEENTH | 1100 | 1 | 0 | 0 | 0 | 0 | 0 | 0 | 0 | 0 | 0 | 0 | 0 | 1 | 0 | ◎ | ○ | ○ | ○ | ○ | ○ | ○ | ○ | ○ | ○ | ○ | ○ | ● | | 179 |
| FOURTEENTH | 1101 | 1 | 0 | 0 | 0 | 0 | 0 | 0 | 0 | 0 | 0 | 0 | 0 | 0 | 1 | ◎ | ○ | ○ | ○ | ○ | ○ | ○ | ○ | ○ | ○ | ○ | ○ | ○ | ● | 215 |
| FIFTEENTH | 1110 | 1 | 0 | 0 | 0 | 0 | 0 | 0 | 0 | 0 | 0 | 0 | 0 | 0 | 0 | ◎ | ○ | ○ | ○ | ○ | ○ | ○ | ○ | ○ | ○ | ○ | ○ | ○ | ○ | 255 |

◎ : WRITE ADDRESS DISCHARGE + SUSTAIN DISCHARGE EMISSION
○ : SUSTAIN DISCHARGE EMISSION
● : ERASE ADDRESS DISCHARGE

FIG. 13

GRAYSCALE DRIVE

DISPLAY BRIGHTNESS

| | DATA CONVERSION TABLE | | | | | | | | | | | | | | | EMISSION PATTERN | | | | | | | | | | | | | | |
|---|---|---|---|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| FIRST | 0000 | 0 | 0 | 0 | 0 | 0 | 0 | 0 | 0 | 0 | 0 | 0 | 0 | 0 | 0 | | | | | | | | | | | | | | | 0 |
| SECOND | 0001 | 1 | 0 | 0 | 0 | 0 | 0 | 0 | 0 | 0 | 0 | 0 | 0 | 0 | 0 | □ | | | | | | | | | | | | | | α |
| THIRD | 0010 | 0 | 1 | 1 | 0 | 0 | 0 | 0 | 0 | 0 | 0 | 0 | 0 | 0 | 0 | | ◎ | ● | | | | | | | | | | | | 1 |
| FOURTH | 0011 | 1 | 1 | 1 | 0 | 0 | 0 | 0 | 0 | 0 | 0 | 0 | 0 | 0 | 0 | □ | ◎ | ● | | | | | | | | | | | | 1+α |
| FIFTH | 0100 | 1 | 1 | 0 | 1 | 0 | 0 | 0 | 0 | 0 | 0 | 0 | 0 | 0 | 0 | □ | ◎ | ○ | ● | | | | | | | | | | | 3+α |
| SIXTH | 0101 | 1 | 1 | 0 | 0 | 1 | 0 | 0 | 0 | 0 | 0 | 0 | 0 | 0 | 0 | □ | ◎ | ○ | ○ | ● | | | | | | | | | | 9+α |
| SEVENTH | 0110 | 1 | 1 | 0 | 0 | 0 | 1 | 0 | 0 | 0 | 0 | 0 | 0 | 0 | 0 | □ | ◎ | ○ | ○ | ○ | ● | | | | | | | | | 17+α |
| EIGHTH | 0111 | 1 | 1 | 0 | 0 | 0 | 0 | 1 | 0 | 0 | 0 | 0 | 0 | 0 | 0 | □ | ◎ | ○ | ○ | ○ | ○ | ● | | | | | | | | 27+α |
| NINTH | 1000 | 1 | 1 | 0 | 0 | 0 | 0 | 0 | 1 | 0 | 0 | 0 | 0 | 0 | 0 | □ | ◎ | ○ | ○ | ○ | ○ | ○ | ● | | | | | | | 39+α |
| TENTH | 1001 | 1 | 1 | 0 | 0 | 0 | 0 | 0 | 0 | 1 | 0 | 0 | 0 | 0 | 0 | □ | ◎ | ○ | ○ | ○ | ○ | ○ | ○ | ● | | | | | | 55+α |
| ELEVENTH | 1010 | 1 | 1 | 0 | 0 | 0 | 0 | 0 | 0 | 0 | 1 | 0 | 0 | 0 | 0 | □ | ◎ | ○ | ○ | ○ | ○ | ○ | ○ | ○ | ● | | | | | 77+α |
| TWELFTH | 1011 | 1 | 1 | 0 | 0 | 0 | 0 | 0 | 0 | 0 | 0 | 1 | 0 | 0 | 0 | □ | ◎ | ○ | ○ | ○ | ○ | ○ | ○ | ○ | ○ | ● | | | | 103+α |
| THIRTEENTH | 1100 | 1 | 1 | 0 | 0 | 0 | 0 | 0 | 0 | 0 | 0 | 0 | 1 | 0 | 0 | □ | ◎ | ○ | ○ | ○ | ○ | ○ | ○ | ○ | ○ | ○ | ● | | | 133+α |
| FOURTEENTH | 1101 | 1 | 1 | 0 | 0 | 0 | 0 | 0 | 0 | 0 | 0 | 0 | 0 | 1 | 0 | □ | ◎ | ○ | ○ | ○ | ○ | ○ | ○ | ○ | ○ | ○ | ○ | ● | | 169+α |
| FIFTEENTH | 1110 | 1 | 1 | 0 | 0 | 0 | 0 | 0 | 0 | 0 | 0 | 0 | 0 | 0 | 1 | □ | ◎ | ○ | ○ | ○ | ○ | ○ | ○ | ○ | ○ | ○ | ○ | ○ | ● | 209+α |
| SIXTEENTH | 1111 | 1 | 1 | 0 | 0 | 0 | 0 | 0 | 0 | 0 | 0 | 0 | 0 | 0 | 0 | □ | ◎ | ○ | ○ | ○ | ○ | ○ | ○ | ○ | ○ | ○ | ○ | ○ | ○ | 255+α |

□ : WRITE ADDRESS DISCHARGE + MICRO EMISSION DISCHARGE

○ : SUSTAIN DISCHARGE EMISSION

◎ : WRITE ADDRESS DISCHARGE + SUSTAIN DISCHARGE EMISSION

● : ERASE ADDRESS DISCHARGE $\alpha < 1$

METHOD FOR DRIVING PLASMA DISPLAY PANEL

BACKGROUND OF THE INVENTION

1. Field of the Invention

The present invention relates to a method for driving a plasma display panel.

2. Description of the Related Art

AC type (AC discharge type) plasma display panels (hereafter PDP) have been commercialized as slim display devices. In a PDP, two substrates, that is a front transparent substrate and a rear substrate, are disposed facing each other with a predetermined space. On the inner face (surface facing the rear substrate) of the front transparent substrate as a display surface, a plurality of row electrode pairs, which extend in the horizontal direction of the screen respectively as a pair, are formed. Also on the inner face of the front transparent substrate, a dielectric layer for coating each of the row electrode pairs, is formed. On the rear substrate, on the other hand, a plurality of column electrodes, which extend in the vertical direction of the screen so as to cross with the row electrode pairs, are disposed. If viewed from the display surface side, pixel cells corresponding to pixels are formed at the intersections of the row electrode pairs and the column electrodes.

Grayscale driving using a subfield method is performed to such a PDP so that half tone display brightness, corresponding to the input video signal, can be acquired.

In the case of grayscale driving based on a subfield method, display driving is performed for all the pixel cells of one screen in each of the plurality of subfields to which an emission count (period) is assigned respectively. In each subfield, an address process and a sustain process are sequentially executed. In the address process, an address discharge is generated according to the input video signal in each pixel cell belonging to the display line to generate (or erase) a predetermined amount of wall charges, sequentially one display line at a time. In a subsequent sustain process, a sustain pulse is applied to all the row electrodes of a PDP respectively for a number of times corresponding to the subfields, so that only the pixel cells, where a predetermined amount of wall sustain-discharge is generated repeatedly for this number of times, and an emission state generated by this discharge is maintained.

According to this driving, the time interval from the generation of a selective discharge in the address process to the generation of a sustain discharge in the subsequent sustain process differs depending on the display line. In other words, the time interval from the generation of a selective discharge to the generation of a first sustain discharge is longer in a pixel cell where the selective discharge was generated at a relatively early point of time of the address process, than in a pixel cell where the selective discharge was generated at a relatively late point of time. In this connection, charged particles generated by a selective discharge are gradually annihilated as time elapses, so it is becoming difficult to stably generate a sustain discharge having a predetermined discharge intensity in a pixel cell of which this time interval is long.

Therefore a drive method for stabilizing a sustain discharge by increasing the pulse width (pulse voltage) of the first sustain pulse to be applied in the sustain process, comparing with the second or later sustain pulses, was proposed. For example, Japanese Patent Kokai No. H07-134565 (Patent document 1) discloses such a driving method.

However if the pulse width of the sustain pulse is increased, the time spent for the sustain process increases accordingly, so it is difficult to increase the number of grayscales by increasing the number of subfields in one field display period. Also in order to increase the pulse voltage of the sustain pulse to be applied first compared with other sustain pulses, two types of different pulse voltages must be generated, which increases the circuit scale of the driver.

SUMMARY OF THE INVENTION

With the foregoing in view, it is an object of the present invention to provide a method for driving a plasma display panel which can generate a stable and reliable sustain discharge without increasing the circuit scale of the driver.

A method for driving a plasma display panel according to the present invention is a method for driving a plasma display panel in which a first substrate and a second substrate are positioned facing each other sandwiching a discharge space in which discharge gas is sealed, and a pixel cell, including a fluorescent layer, is formed at each intersection of a plurality of row electrode pairs formed on the first substrate and a plurality of column electrodes formed on the second substrate, by dividing one field display period of the video signal into a plurality of subfields and driving each subfield independently, wherein one field display period has: a plurality of subfields, each of which executes an address process for setting the pixel cells to ON mode or to OFF mode by address-discharging the pixel cells selectively according to a pixel data of each pixel based on a video signal, and a sustain process for repeatedly sustain-discharging only the pixel cells being set to the ON mode for a number of times assigned corresponding to a brightness weight of the subfield by sequentially applying a sustain pulse to one row electrode of the row electrode pair and to the other row electrode alternately for the number of times; and a subfield for executing a reset process for initializing each of the pixel cells to one state out of the OFF mode and the ON mode by reset-discharging each of the pixel cells, in addition to the address process and the sustain process, and in the one field display period, an auxiliary pulse is applied to the column electrode only while a first sustain pulse is being applied in the sustain process of at least one subfield out of the subfields in which the reset process is not executed.

The plasma display panel, where a pixel cell is formed at each intersection of a plurality of column electrodes, and a plurality of row electrode pairs, is driven as follows. In one field display period, a plurality of subfields, each of which executes an address process for setting each pixel cell to ON mode or OFF mode according to the input video signal and a sustain process for sustain-discharging only pixel cells being set to ON mode by applying a sustain pulse to the row electrode, are formed. Also in this one field display period, a subfield, for executing a reset processing for initializing each pixel cell to one state out of OFF mode and ON mode by reset-discharging, in addition to the address process and the sustain process, is formed. In the sustain process of at least one subfield out of the subfields in which the reset process is not executed, an auxiliary pulse is applied to the column electrode only while the first sustain pulse is being applied, so that the auxiliary discharge is generated along with the sustain discharge. According to this driving, the first discharge generated in the sustain process becomes a relatively strong discharge (sustain discharge+auxiliary discharge). Therefore when the amount of charged particles remaining in the pixel cell is very low, that is in the case of the previous subfield of the subfield in which a reset discharge is not generated and the number of times of sustain discharge is low, the problem of an insufficient amount of charged particles is solved by the strong discharge initially generated (sustain discharge+auxiliary discharge). The second and later sustain discharges can be generated without fail. Therefore according to the present invention, sustain discharge can be surely generated without increasing the pulse width of the sustain pulse or the pulse voltage thereof, so the scale of the PDP driver can be decreased.

BRIEF DESCRIPTION OF THE DRAWINGS

FIG. 6 is a table showing an example of the emission pattern for each grayscale;

FIG. 13 is a table showing an example of an emission pattern for each grayscale based on the emission drive sequence shown in FIG. 12.

DETAILED DESCRIPTION OF THE INVENTION

Figure 1:
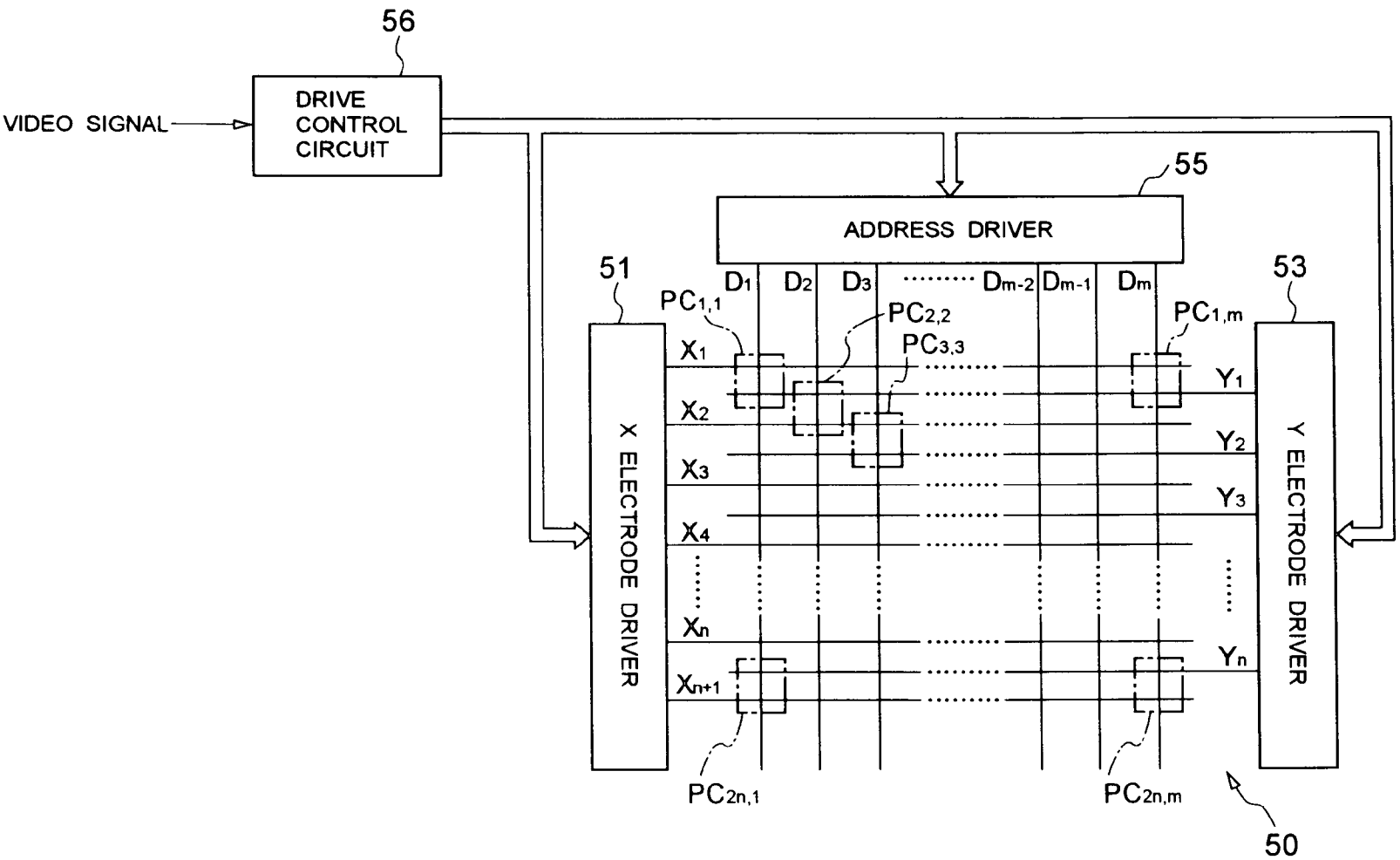
FIG. 1 is a diagram depicting a general configuration of the plasma display device according to the present invention.

FIG. 1 is a diagram depicting a general configuration of a plasma display device for driving a plasma display panel according to the drive method of the present invention.

As FIG. 1 shows, this plasma display device comprises a PDP 50 as a plasma display panel, an X electrode driver 51, a Y electrode driver 53, an address driver 55, and a drive control circuit 56.

In the PDP 50, column electrodes $D_1$ to $D_m$ extended and arrayed in a longitudinal direction (vertical direction) of a two-dimensional display screen, and row electrodes $X_1$ to $X_n$ and row electrodes $Y_1$ to $Y_n$ extended and arrayed in a lateral direction (horizontal direction) respectively, are formed. Each pair formed by adjacent row electrodes $(Y_1, X_1)$, $(Y_2, X_2)$, $(Y_3, X_1)$, . . . , $(Y_n, X_n)$ plays a role of the first display line to the nth display line in the PDP 50. In an intersection of each display line and each of the column electrodes $D_1$ to $D_m$ (an area enclosed by the dashed line in FIG. 1), a pixel cell PC, which plays a part of a pixel, is formed. In other words, in the PDP 50, pixel cells $PC_{1,1}$ to $PC_{1,m}$ belonging to the first display line, pixel cells $PC_{2,1}$ to $PC_{2,m}$ belonging to the second display line, . . . pixel cells $PC_{n,1}$ to $PC_{n,m}$ belonging to the nth display line, are arrayed in a matrix.

Figure 2:
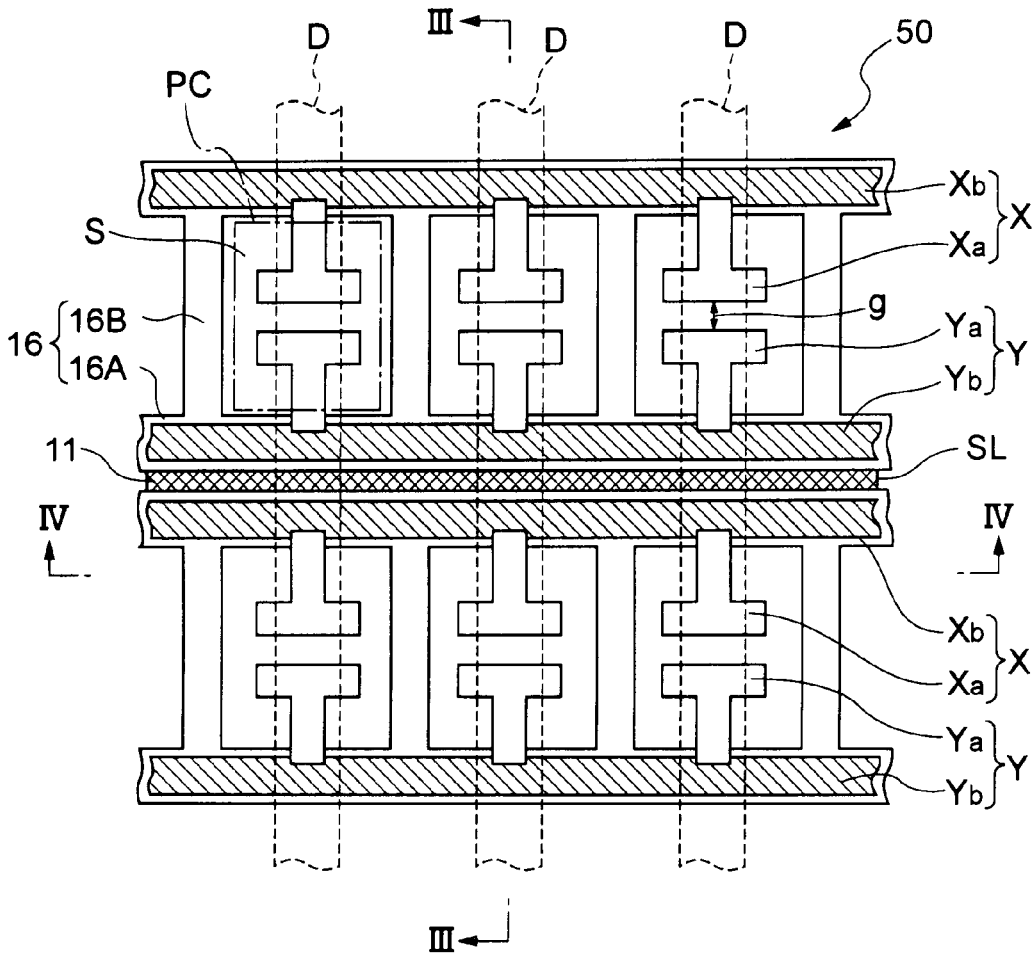
FIG. 2 is a front view depicting the internal structure of the PDP 50 viewed from the display surface side.
Figure 3:
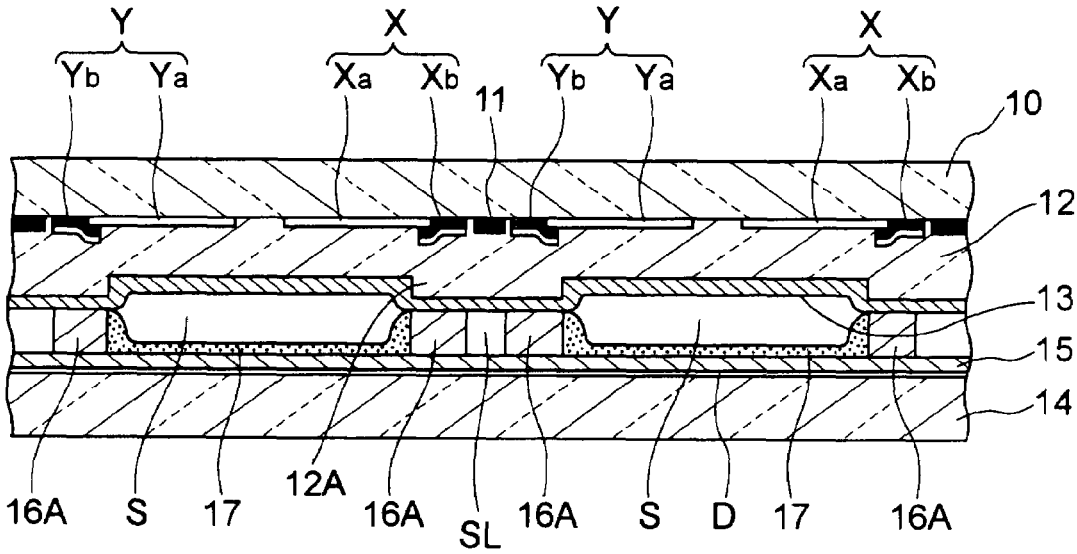
FIG. 3 is a cross-sectional view sectioned along the III III line in FIG. 2.
Figure 4:
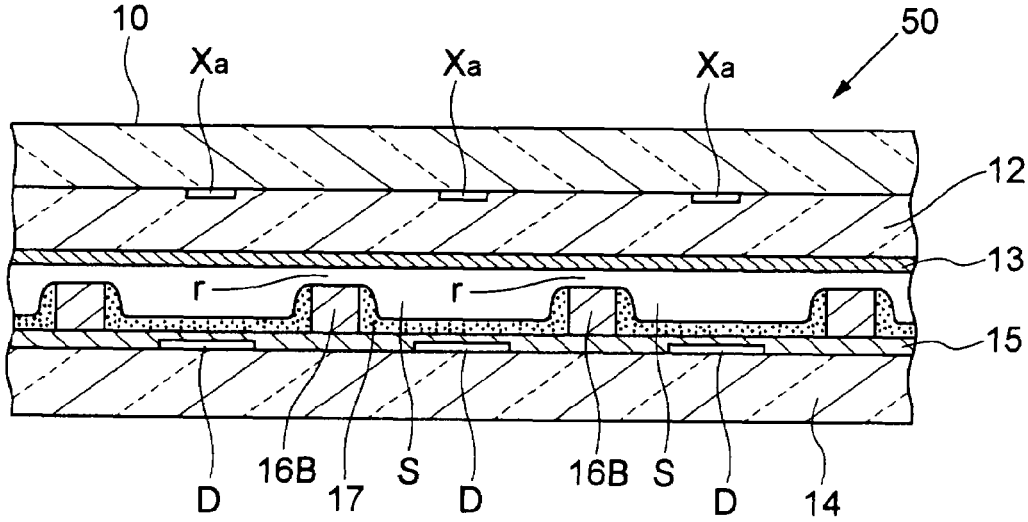
FIG. 4 is a cross-sectional view sectioned along the IV IV line in FIG. 2.

FIG. 2 is a front view depicting an internal structure of the PDP 50 viewed from the display surface side. FIG. 2 shows the intersections of the three column electrodes D, which are adjacent to each other, and the two display lines, which are adjacent to each other. FIG. 3 is a cross-sectional view of the PDP 50 along the III III line in FIG. 2, and FIG. 4 is a cross-sectional view of the PDP 50 along the IV IV line in FIG. 2.

As FIG. 2 shows, each row electrode X is comprised of a bus electrode Xb which extends in a horizontal direction of the two-dimensional display screen, and a T-shaped transparent electrode Xa which is formed contacting each pixel cell PC on the bus electrode Xb respectively. Each row electrode Y is comprised of a bus electrode Yb which extends in the horizontal direction of the two-dimensional display screen, and a T-shaped transparent electrode Ya formed contacting each pixel cell PC on the bus electrode Yb respectively. The transparent electrodes Xa and Ya are formed of a transparent conductive film, such as ITO, and the bus electrodes Xb and Yb are formed of a metal film, for example. The row electrode X comprised of the transparent electrode Xa and the bus electrode Xb, and the row electrode Y comprised of the transparent electrode Ya and the bus electrode Yb are formed on the back face of the front transparent substrate 10 of which front face is the display surface of the PDP 50, as shown in FIG. 3. The transparent electrodes Xa and Ya in each row electrode pair (X, Y) mutually extend toward the partner row electrode of the pair, and the top sides thereof of which width is wide, face each other with a discharge gap g1 having a predetermined width. On the back face of the front transparent substrate 10, a black or dark color light absorption layer (light shielding layer) 11, which extends in a horizontal direction of the two-dimensional display screen, is formed between a row electrode pair (X, Y) and a row electrode pair (X, Y) which is adjacent to this row electrode pair (X, Y). Also on the back face of the front transparent substrate 10, a dielectric layer 12 is formed covering the row electrode pairs (X, Y). On the back face of the dielectric layer 12 (a surface opposite from the surface to which the row electrode pairs contact), a carry dielectric layer 12A is formed at a portion corresponding to the area where the light absorption layer 11 and bus electrodes Xb and Yb adjacent to this light absorption layer 11 are formed, as shown in FIG. 3.

On the surface of the dielectric layer 12 and the carry dielectric layer 12A, a magnesium oxide layer 13 is formed. The magnesium oxide layer 13 contains a magnesium oxide crystalline as a secondary electron emission material which is excited by the irradiated electron beam, and performs CL (Cathode Luminescence) emission of which peak is within 230 to 250 nm out of the wavelength 200 to 300 nm (hereafter called CL emission MgO crystalline). This CL emission MgO crystalline is acquired by performing vapor phase oxidation for magnesium steam which is generated by heating magnesium, and has a multiple crystal structure where cubic crystallines are mutually engaged, for example, or a cubic single crystal structure. The average particle size of a CL emission MgO crystalline is 2000 or more (measurement result by BET method).

To form the vapor phase method magnesium oxide single crystallines of which average particle size is 2000 or more it is necessary to increase the heating temperature when magnesium steam is generated. This makes the length of a flame longer when magnesium and oxygen react, and increase the temperature difference between the flame and surroundings, thereby many vapor phase method magnesium oxide single crystallines having a large particle size that have an energy level corresponding to the above mentioned CL emission peak wavelength (e.g. about 235 nm, within 230 to 250 nm) are formed.

Compared with a general vapor phase oxidation method, the vapor phase method magnesium oxide single crystallines generated by increasing the amount of magnesium evaporated per unit time and increasing the reaction area between magnesium and oxygen, so as to react with more oxygen, has an energy level corresponding to the above mentioned CL emission peak wavelength.

By attaching the CL emission MgO crystallines onto the surface of the dielectric layer 12 by a spray method or electrostatic coating method, the magnesium oxide layer 13 is formed. The magnesium oxide layer 13 may be formed by forming the magnesium oxide layer on the surface of the dielectric layer 12 by deposition or sputtering method, and attaching CL emission MgO crystalline thereon.

On the rear substrate 14 disposed in parallel with the front transparent substrate 10, each column electrode D extends in a direction that is perpendicular to the row electrode pair (X, Y) at positions facing the transparent electrodes Xa and Ya in each row electrode pair (X, Y). On the rear substrate 14, a white column electrode protective layer 15, which coats the column electrode D, is also formed. A barrier 16 is formed on this column electrode protective layer 15. The barrier 16 is formed like a ladder by a lateral barrier 16A which extends in a lateral direction of the two-dimensional display screen at a position corresponding to the bus electrodes Xb and Yb of each row electrode pair (X, Y) respectively, and a longitudinal barrier 16B which extends in a longitudinal direction of the two-dimensional display screen at each center position between adjacent column electrodes D. Also a ladder type barrier 16, shown in FIG. 2, is formed for each display lone of the PDP 50. A gap SL, shown in FIG. 2, exists between adjacent barriers 16. By the ladder type barrier 16, a pixel cell PC, including an independent discharge space S and transparent electrodes Xa and Ya, is partitioned. In the discharge space S, discharge gas containing xenon gas is sealed in. A fluorescent layer 17 is formed on the side face of the lateral wall 16A, the side face of the longitudinal wall 16B and the surface of the column electrode protective layer 15 in each pixel cell PC, so as to completely cover all these surfaces. This fluorescent layer 17 actually has three types of fluorescent materials: a fluorescent material which performs red emission, a fluorescent material which performs green emission, and a fluorescent material which performs blue emission.

Figure 5:
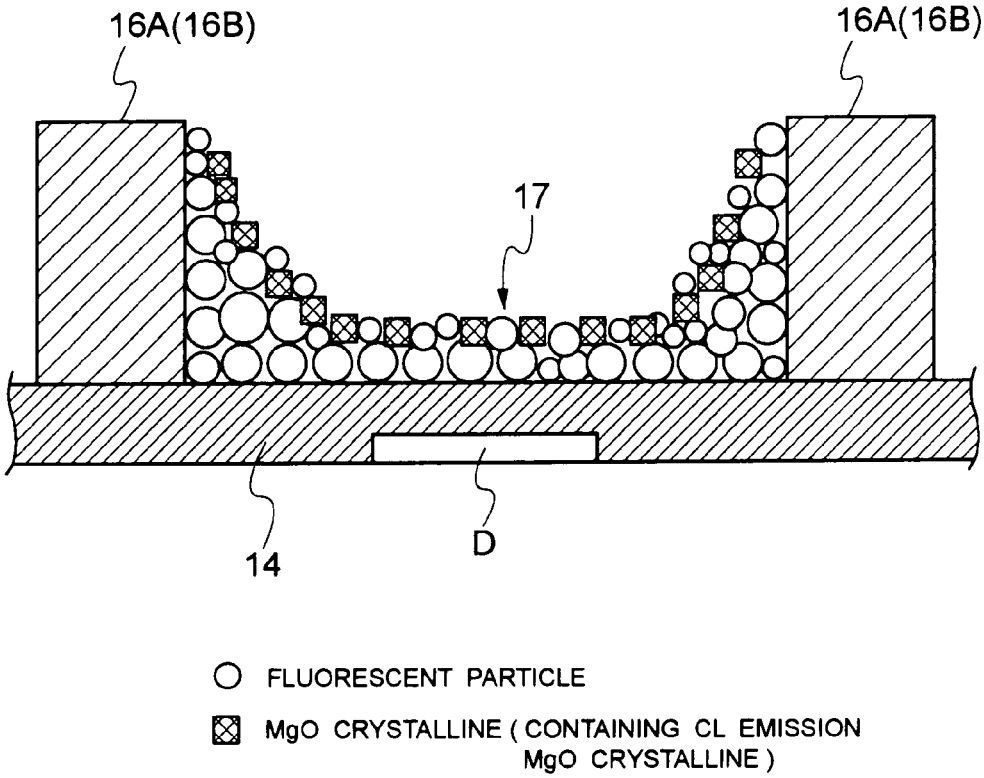
FIG. 5 is a diagram depicting the MgO crystalline contained in the fluorescent layer 17.

The fluorescent layer 17 contains MgO crystallines (including CL emission MgO crystallines) as the secondary emission material in a form shown in FIG. 5, for example. At least on the surface of the fluorescent layer 17, that is on the surface contacting the discharge space S, the MgO crystallines are exposed from the fluorescent layer 17 so as to contact the discharge gas.

The space between the discharge space S and the gap SL of each pixel cell PC is closed by the magnesium oxide layer 13 contacting the lateral wall 16A, as shown in FIG. 3. The longitudinal wall 16B does not contact the magnesium oxide layer 13, as shown in FIG. 4, so the gap r exists. In other words, each discharge space S of adjacent pixel cells PC in the lateral direction of the two-dimensional display screen is interconnected via this gap r.

The drive circuit 56 first converts an input video signal into 8-bit pixel data which represents all the brightness levels with 256 grayscales for each pixel, and performs multi-grayscale processing comprised of error diffusion processing and dither processing on this pixel data. In other words, in the error diffusion processing, the higher 6 bits of the pixel data is regarded as display data, and the remaining lower 2 bits is regarded as error data, and the error data of the pixel data corresponding to each peripheral pixel is weighed, added and reflected in the display data, thereby 6-bit error diffusion processed pixel data is acquired. According to this error diffusion processing, the brightness of the lower 2 bits in the original pixel is pseudo-represented by the peripheral pixels, so a brightness grayscale equivalent to 8-bit pixel data can be expressed by display data of 6 bits less than 8 bits. Then the drive control circuit 56 performs dither processing on the 6-bit error diffusion processed pixel data acquired by this error diffusion processing. In the dither processing, a plurality of adjacent pixels are regarded as 1 pixel unit, and a different dither coefficient is assigned respectively to the error diffusion processed pixel data corresponding to each pixel of 1 pixel unit, and added, by which dither added pixel data is acquired. By this addition of dither coefficients, brightness corresponding to 8 bits can be represented only by the higher 4 bits of dither added pixel data when the image is viewed in pixel units. Therefore the drive control circuit 56 regards the higher 4 bits of the dither added pixel data as multi-grayscale pixel data $PD_S$ which represent all the brightness levels with 15 grayscales, as shown in FIG. 6. Then the drive control circuit 56 converts the multi-grayscale pixel data $PD_S$ into 14-bit pixel drive data GDs according to the data conversion table shown in FIG. 6. The drive control circuit 56 corresponds the first to fourteenth bit of the pixel drive data GDs to the subfields SF1 to SF14 (mentioned later) respectively, and supplies the bit digit corresponding to the subfield SF to the address driver 55 for one display line (m pixels) at a time as the pixel drive data bits.

Figure 7:
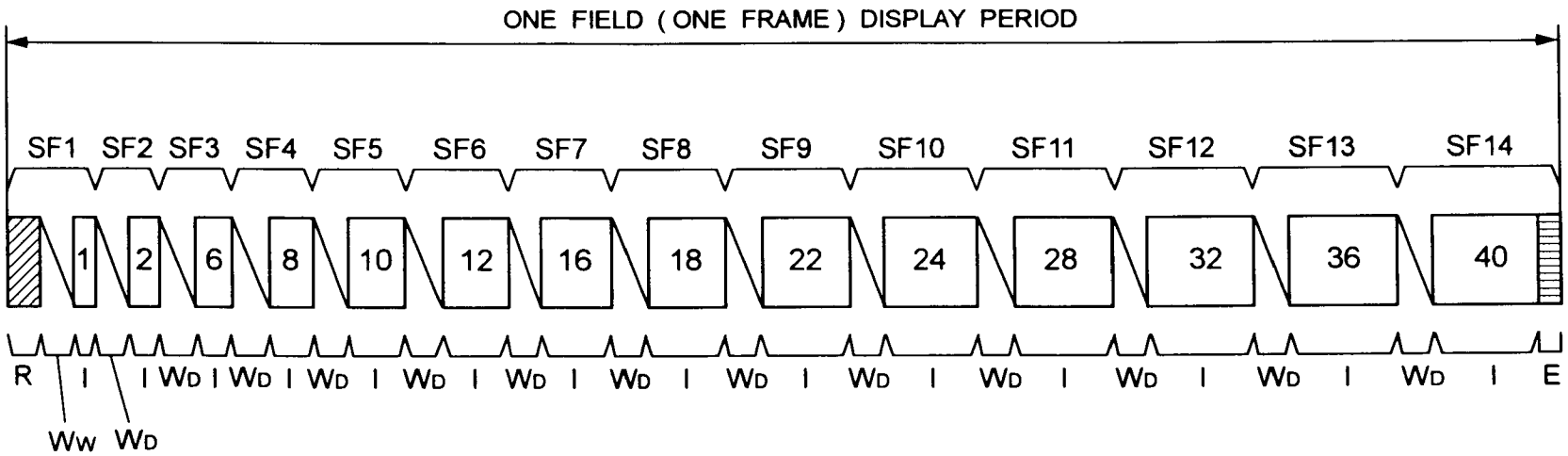
FIG. 7 is a diagram depicting an example of the emission drive sequence used for the plasma display device shown in FIG. 1.

Also the drive control circuit 56 supplies various control signals for driving the PDP 50 having the above mentioned structure according to the emission drive sequence shown in FIG. 7 to the panel driver which is comprised of the X electrode driver 51, Y electrode driver 53 and address driver 55. In other words, the drive control circuit 56 supplies various control signals for sequentially performing driving according to the reset process R, selective write address process $W_W$ and sustain process I, to the panel driver in a first subfield SF1 in a one field (one frame) display period shown in FIG. 7. In each subfield SF2 to SF14, the drive control circuit 56 supplies various control signals for sequentially performing driving according to the selective erase address process $W_D$ and sustain process I to the panel driver. Only in the last subfield SF14 of the one field display period, however, the drive control circuit 56 supplies various control signals for sequentially performing driving according to the erase process E to the panel driver after executing the sustain process I.

Figure 8:
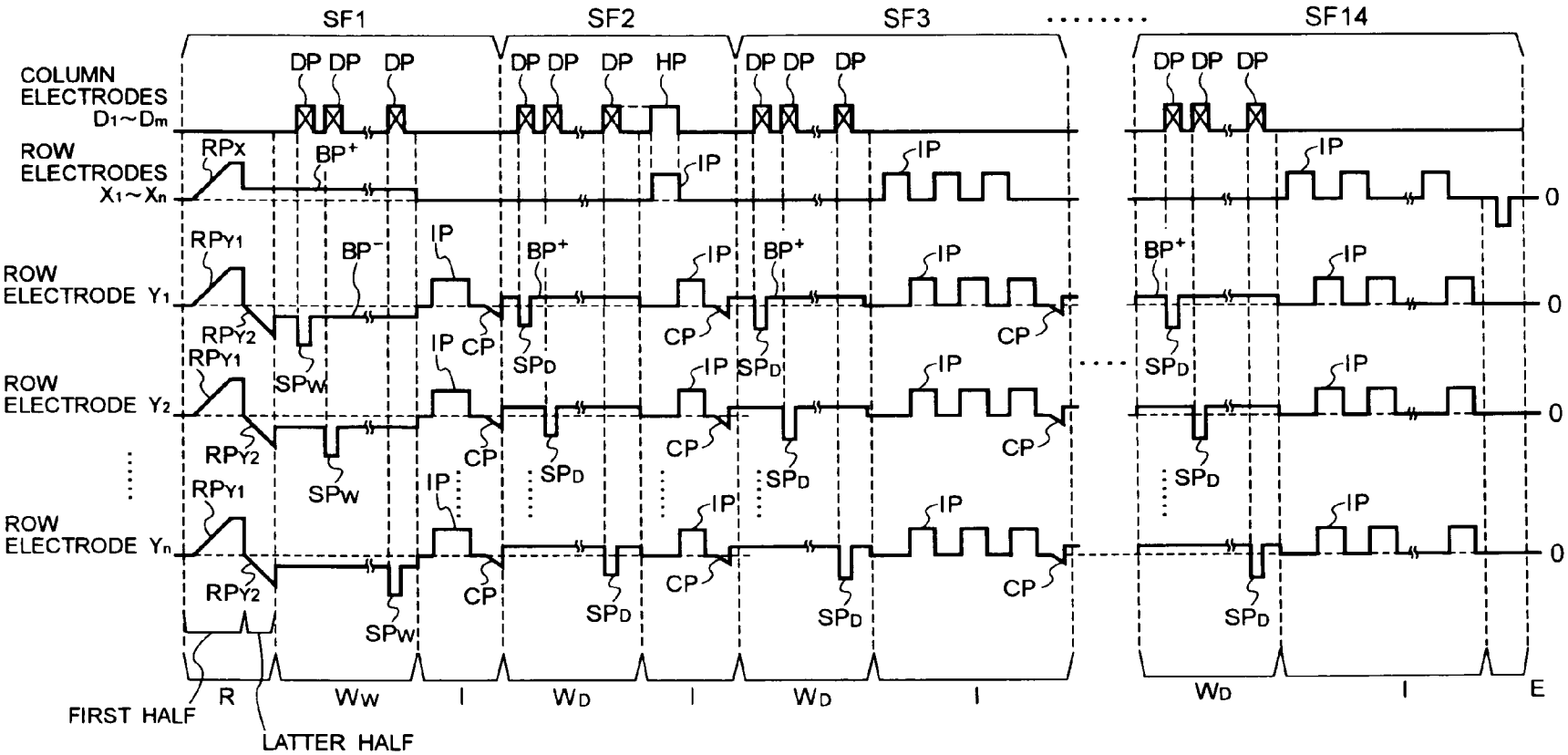
FIG. 8 is a diagram depicting various drive pulses applied to the PDP 50 according to the emission drive sequence shown in FIG. 7.

The panel driver, that is the X electrode driver 51, Y electrode driver 53 and address driver 55, generates various drive pulses shown in FIG. 8 according to various control signals supplied by the drive control circuit 56, and supplies them to the column electrodes D and row electrodes X and Y of the PDP 50.

FIG. 8 shows only the operation of the first subfield SF1, subsequent subfield SF2 and the last subfield SF14 out of the subfields SF1 to SF14 shown in FIG. 7.

In the first half section of the reset process R in subfield SF1, the Y electrode driver 53 applies a positive polarity reset pulse $RP_{Y1}$ having a waveform of which potential transition at the leading edge with the lapse of time is gentle, compared with the later mentioned sustain pulse, to all the row electrodes $Y_1$ to $Y_n$. The peak potential of the reset pulse $RP_{Y1}$ is higher than the peak potential of the sustain pulse. During this time, the address driver 55 sets the column electrodes $D_1$ to $D_m$ to a ground potential (0 volts) state. As the reset pulse $RP_{Y1}$ is applied, the first reset discharge is generated between the row electrode Y and the column electrode D in each one of all the pixel cells PC. In other words, in the first half of the reset process R, voltage is applied between the electrodes such that the anode side is the row electrode Y and the cathode side is the column electrode D, by which discharge for flowing current from the row electrode Y to the column electrode D (hereafter called column side cathode discharge) is generated as the first reset discharge. By this first reset discharge, negative polarity wall charges are formed near the row electrode Y, and positive polarity wall charges are formed near the column electrode D in all the pixel cells PC.

In the first half section of the reset process R, the X electrode driver 51 applies a reset pulse $RP_x$, which has the same polarity as the reset pulse $RP_{Y1}$ and has a peak potential that can prevent surface discharge between the row electrodes X and Y when the reset pulse $RP_{Y1}$ is applied, to each of all the row electrodes $X_1$ to $X_n$.

In the latter half section of the reset process R in subfield SF1, the Y electrode driver 53 generates a negative polarity reset pulse $RP_{Y2}$ of which potential transition at the leading edge with the lapse of time is gentle, and applies this to all the row electrodes $Y_1$ to $Y_n$. In the latter half section of the reset process R, the X electrode driver 51 applies a base pulse BP+ having a predetermined positive polarity base potential to each of all the row electrodes $X_1$ to $X_n$. As the negative polarity reset pulse $RP_{Y2}$ and the positive polarity base pulse BP+ are applied, the second reset discharge is generated between the row electrodes X and Y in all the pixel cells PC. The respective peak potential of reset pulse $RP_{Y2}$ and base pulse BP+ is a minimum potential that can generate the second reset discharge between the row electrodes X and Y without fail, considering the wall charges formed near the row electrodes X and Y respectively by to the first reset discharge. The negative peak potential of the reset pulse $RP_{Y2}$ is set to a potential higher than the peak potential of the later mentioned negative polarity write scan pulse $SP_W$, that is a potential close to 0 volts. In other words, if the peak potential of the reset pulse $RP_{Y2}$ is lower than the peak potential of the write scan pulse $SP_W$, a strong discharge is generated between the row electrode Y and the column electrode D, and a large amount of wall charges formed near the column electrode D are erased, which makes address discharge unstable in the selective write address process $W_W$. By the second reset discharge generated in the latter half section of the reset process R, the wall charges formed near the row electrodes X and Y respectively in each pixel cell PC are erased, and all the pixel cells PC are initialized to OFF mode. Also as the reset pulse $RP_{Y2}$ is applied, a weak discharge is generated between the row electrode Y and the column electrode D in all the pixel cells PC, a part of the positive polarity wall charges formed near the column electrode D is erased, and is adjusted to an amount which can generate a selective write address discharge correctly in the later mentioned selective write address process $W_W$.

In the selective write address process $W_W$ in subfield SF1, the Y electrode driver 53 sequentially and alternately applies a write scan pulse $SP_W$ having a negative polarity peak potential to the row electrodes $Y_1$ to $Y_n$ respectively while simultaneously applying a base pulse BP having a predetermined negative polarity base potential, as shown in FIG. 8, to the row electrodes $Y_1$ to $Y_n$. The X electrode driver 51 continuously applies the base pulse BP+, which was applied to the row electrodes $X_1$ to $X_n$ in the latter half section of the reset process R, to the row electrodes $X_1$ to $X_n$ in the selective write address process $W_W$. The respective potential of the base pulse BP− and the base pulse BP+ are set to a potential such that the voltage between the row electrodes X and Y becomes lower than the discharge start voltage of the pixel cell PC in a period when the write scan pulse $SP_W$ is not applied.

Also in the selective write address process $W_W$, the address driver 55 converts the pixel drive data bit corresponding to subfield SF1 into a pixel data pulse DP having a pulse voltage according to the logic level thereof. For example, if the pixel drive data bit with logic level 1 for setting the pixel cell PC to ON mode is supplied, the address driver 55 converts this to the pixel data pulse DP having a positive polarity peak potential. For the pixel drive data bit with logic level 0 for setting the pixel cell PC to OFF mode, on the other hand, the address driver 55 converts this into low voltage (0 volts) pixel data pulse DP. Then the address driver 55 applies this pixel data pulse DP to the column electrodes $D_1$ to $D_m$ synchronizing with the applying timing of each write scan pulse $SP_W$ for one display line (m pixels) at a time. In this case, at the same time with this write scan pulse $SP_W$, a selective write address discharge is generated between the column electrode D and the row electrode Y in the pixel cell PC where a high voltage pixel data pulse DP for setting the pixel cell to ON mode is applied. Immediately after this selective write address discharge, a weak discharge is also generated between the row electrodes X and Y in the pixel cell PC. In other words, after the write scan pulse $SP_W$ is applied, voltage, according to the base pulse BP− and the base pulse BP+ between the row electrodes X and Y, is applied, but this voltage is set to a voltage lower than the discharge start voltage of each pixel cell PC, so a discharge is not generated in the pixel cell PC by this voltage alone. If the selective write address discharge is generated, however, a discharge is generated between the row electrodes X and Y, induced by this selective write address discharge, only by the voltage applied based on the base pulse BP− and base pulse BP+. By this discharge and selective write address discharge, the pixel cell PC is set to ON mode, where positive polarity wall charges are formed near the row electrode Y, negative polarity wall charges are formed near the row electrode X, and negative polarity wall charges are formed near the column electrode D respectively. The selective write address discharge is not generated between the column electrode D and the row electrode Y of the pixel cell PC, where a low voltage (0 volts) pixel data pulse DP for setting the pixel cell to OFF mode is applied at the same time with the write scan pulse $SP_W$, therefore a discharge is not generated between the row electrodes X and Y. As a consequence, this pixel cell PC maintains the previous state, that is the state of OFF mode initialized in the reset process R.

Then in the sustain process I in subfield SF1, the Y electrode driver 53 generates a sustain pulse IP having a positive polarity peak potential only for one pulse, and simultaneously applies this to each of the row electrodes $Y_1$ to $Y_n$. During this time, the X electrode driver 51 sets the row electrodes $X_1$ to $X_n$ to the ground potential (0 volts) state, and the address driver 55 sets the column electrodes $D_1$ to $D_m$ to ground potential (0 volts) state. As the sustain pulse IP is applied, a sustain discharge is generated between the row electrodes X and Y in the pixel cell PC being set to ON mode. Along with this sustain discharge, light emitted from the fluorescent layer 17 is irradiated outside through the front transparent substrate 10, whereby one time of display emission is performed according to the brightness weight of subfield SF1. As this sustain pulse IP is applied, a discharge is also generated between the row electrode Y and the column electrode D in the pixel cell PC being set to ON mode. By this discharge and sustain discharge, negative polarity wall charges are formed near the row electrode Y, and positive polarity wall charges are formed near the row electrode X and column electrode D respectively in the pixel cell PC. After the sustain pulse IP is applied, the Y electrode driver 53 applies a wall charge adjustment pulse CP having a negative polarity peak potential of which potential transition at the leading edge with the lapse of time is gentle, as shown in FIG. 8, to the row electrodes $Y_1$ to $Y_n$. As this wall charge adjustment pulse CP is applied, a weak erase discharge is generated in the pixel cell PC where the sustain discharge is generated, as mentioned above, and a part of the wall charges formed inside the pixel cell is erased. By this, the amount of wall charges inside the pixel cell PC is adjusted to the amount that can generate the selective erase address discharge correctly in the next selective erase address process $W_D$.

Then in the selective erase address process $W_0$ in each subfield SF2 to SF14, the Y electrode driver 53 sequentially and alternately applies the erase scan pulse $SP_D$ having a negative polarity peak potential, as shown in FIG. 8, to each row electrode $Y_1$ to $Y_n$ while applying the base pulse BP+ having a predetermined positive polarity base potential to the row electrodes $Y_1$ to $Y_n$ respectively. The peak potential of the base pulse BP+ is set to a potential that can prevent an incorrect discharge between the row electrodes X and Y when the selective erase address process $W_0$ is being executed. Also when the selective erase address process $W_0$ is being executed, the X electrode driver 51 sets each row electrode $X_1$ to $X_n$ to ground potential (0 volts). In this selective erase address process $W_0$, the address driver 55 converts the pixel drive data bit corresponding to the subfield SF into the pixel data pulse DP having a pulse voltage according to the logic level thereof. For example, if the pixel drive data bit with logic level 1 for shifting the pixel cell PC from ON mode to OFF mode is supplied, the address driver 55 converts this into the pixel data pulse DP having a positive polarity peak potential. If the pixel drive data bit with logic level 0 for maintaining the current state of the pixel cell PC is supplied, on the other hand, the address driver 55 converts this into the low voltage (0 volts) pixel data pulse DP. Then the address driver 55 applies this pixel data pulse DP to the column electrodes $D_1$ to $D_m$ synchronizing with the timing of applying each erase scan pulse $SP_D$ for one display line (m pixels) at a time. In this case, a selective erase address discharge is generated between the column electrode D and the row electrode Y in the pixel cell PC where the high voltage pixel data pulse DP is applied at the same time with the erase scan pulse $SP_D$. By this selective erase address discharge, this pixel cell PC is set to OFF mode, where positive polarity wall charges are formed near the row electrodes X and Y, and negative polarity wall charges are formed near the column electrode D. This selective erase address discharge is not generated between the column electrode D and the row electrode Y in a pixel cell PC where the low voltage (0 volts) pixel data pulse DP is applied at the same time with the erase scan pulse $SP_D$. Therefore this pixel cell PC maintains the previous state (ON mode, OFF mode).

In the sustain process I in each subfield SF2 to SF14, the X electrode driver 51 and the Y electrode driver 53 apply the sustain pulse IP having a positive polarity peak potential to each row electrode $X_1$ to $X_n$ and $Y_1$ to $Y_n$ (alternately to the row electrodes X and Y) repeatedly for the number of times (even number of times) corresponding to the brightness weight of the subfield as shown in FIG. 8. Each time this sustain pulse IP is applied, the sustain discharge is generated between the row electrodes X and Y in a pixel cell PC being set to ON mode. The light emitted from the fluorescent layer 17 is irradiated outside via the front transparent substrate 10 along with this sustain discharge, whereby the display emission is performed for a number of times according to the brightness weight of the subfield SF. In this case, negative polarity wall charges are formed near the row electrode Y, and positive polarity wall charges are formed near the row electrode X and the column electrode D respectively in the pixel cell PC where the sustain discharge is generated according to the sustain pulse IP applied last in each sustain process I in subfields SF2 to SF14. After this last sustain pulse IP is applied, the Y electrode driver 53 applies the wall charge adjustment pulse CP having a negative polarity peak potential of which potential transition at a leading edge with the lapse of time is gentle, as shown in FIG. 8, to the row electrodes Y1 to Yn. As this wall charge adjustment pulse CP is applied, a weak erase discharge is generated in the pixel cell PC where the above mentioned sustain discharge is generated, and a part of the wall charges formed inside the pixel cell is erased. By this, the amount of the wall charges in the pixel cell PC is adjusted to an amount that can generate the selective erase address discharge correctly in the next selective erase address process $W_D$.

In the sustain process I in SF2 of the subfields SF2 to SF14, the address driver 55 applies an auxiliary pulse HP having a positive polarity peak potential shown in FIG. 8 to the column electrodes $D_1$ to $D_m$ respectively, synchronizing only with the sustain pulse IP which his applied first in the sustain process I. In this case, the peak potential of the auxiliary pulse HP is the same as the peak potential of the pixel data pulse DP, and the pulse width thereof is the same as the pulse width of the sustain pulse IP which is applied the first time in the sustain process I of the subfield SF2. According to this auxiliary pulse HP, a discharge (hereafter called auxiliary discharge) is generated between the column electrode D and the row electrode Y in the pixel cell PC being set to ON mode. In other words, in the beginning of the sustain process I of the subfield SF2, the sustain discharge according to the first sustain pulse IP is generated between the row electrodes X and Y in the pixel cell PC being set to ON mode, and at the same time an auxiliary discharge according to the auxiliary pulse HP is generated between the column electrode D and the row electrode Y. Therefore during this time, many charged particles are generated in the pixel cells PC compared with the case when only a sustain discharge is generated. By this, a second and later sustain discharge can be generated without fail. The discharge according to the auxiliary pulse HP is performed only once in the sustain process I, so power consumption due to this discharge is minor.

At the end of the last subfield SF14, the Y electrode driver 53 applies an erase pulse EP having a negative polarity peak potential to all the row electrodes $Y_1$ to $Y_n$. As this erase pulse EP is applied, an erase discharge is generated only in a pixel cell PC in ON mode. By this erase discharge, the pixel cell PC in ON mode shifts to OFF mode.

In this way, in the plasma display device shown in FIG. 1, a driving where the subfield including the selective write address process $W_W$ (SF1) and the subfields including the selective erase address process $W_D$ (SF2 to SF14) coexist in one field display period (hereafter called hybrid driving) is executed for the PDP 50. In this case, if the PDP 50 is a drive according to the 15 types of pixel drive data GD shown in FIG. 6, a write address discharge is generated (indicated by dual circles) in each pixel cell PC in the first subfield SF1, except in the case of representing the brightness level 0 (first grayscale), and this pixel cell PC is set to ON mode. Then the selective erase address discharge is generated (indicated by a solid black circle) only in the selective erase address process $W_0$ of one subfield out of the subfields SF2 to SF14, and the pixel cell PC is set to OFF mode. In other words, each pixel cell PC is set to ON mode in continuous subfields corresponding to the half tone brightness to be represented, and repeatedly generates emission (indicated by circle) due to the sustain discharge, for a number of times assigned to each of these subfields. In this case, brightness corresponding to the total number of sustain discharges generated in one field (or one frame) display period is visually recognized. Therefore according to the 15 types of emission patterns generated by the first to fifteenth grayscale driving, as shown in FIG. 6, 15 grayscales of half tone brightness corresponding to the total number of times of sustain discharge in each subfield indicated by a circle can be represented. According to this driving, areas where the emission pattern (ON state, OFF state) are inverted from each other do not coexist in one screen in one field display period, so a pseudo contour generated in such a state can be prevented.

In the driving shown in FIG. 8, the first reset discharge is generated between the row electrodes Y, which are formed at the front transparent substrate 10, and the column electrodes D, which are formed at the rear substrate 14 as shown in FIG. 3. Therefore compared with the case of generating a reset discharge between the row electrodes X and Y, both formed on the front transparent substrate 10, the discharge light emitted to the outside from the front transparent substrate 10 decreases, so dark contrast can be further improved.

Also in the driving shown in FIG. 8, after the reset discharge for initializing all the pixel cells PC to OFF mode state is generated in the first subfield SF1, the selective write address discharge for shifting the pixel cells PC in OFF mode state to ON mode state is generated. Then in one subfield out of the subsequent subfields SF2 to SF14 of SF1, the selective erase address discharge for shifting the pixel cells PC in ON mode state to OFF mode state, that is the selective erase address method, is executed. Therefore if a black display (brightness level 0) is performed by this driving, a discharge generated throughout the one field display period is only the reset discharge in the first subfield SF1. In other words, compared with the case of generating the reset discharge for initializing all the pixel cells PC to ON mode state in the first subfield SF1, and then generating the selective erase address discharge for shifting this to OFF mode state, the number of times of a discharge generated throughout one field display period decreases. As a consequence, contrast when a dark image is displayed, that is a dark contrast, can be improved.

In the case of the driving shown in FIG. 8, the column side cathode discharge, where current flows from the row electrode Y to the column electrode D, is generated as the first reset discharge, by applying voltage of which cathode side is the column electrode D and the anode side is the row electrode Y between both electrodes in the reset process R of the first subfield SF1. Therefore, in the first reset discharge, cations in the discharge gas collide with the MgO crystallines as the secondary electron emission material contained in the fluorescent layer 17 shown in FIG. 5 when cations move to the column electrode D, and secondary electrons are emitted from the MgO crystallines. Particularly in the case of PDP 50 of the plasma display device shown in FIG. 1, the probability of collision with cations is increased by exposing the MgO crystallines to the discharge space, as shown in FIG. 5, so that the secondary electrons are discharged efficiently. Then the discharge start voltage of the pixel cell PC decreases by the priming function of the secondary electrons, so a relatively weak reset discharge can be generated. Also the reset discharge can be even weaker by MgO crystallines partially containing CL emission MgO crystallines. Since weakening of the reset discharge drops the emission brightness generated by the discharge, a display with improved dark contrast can be implemented. In the case of the PDP 50 shown in FIG. 1, CL emission MgO crystallines as the secondary electron emission material are contained not only in the magnesium oxide layer 13 formed on the front transparent substrate 10 in each pixel cell PC, but also in the fluorescent layer 17 formed on the rear substrate 14.

Now the functional effect of using this configuration will be described with reference to FIG. 9 and FIG. 10.

Figure 9:
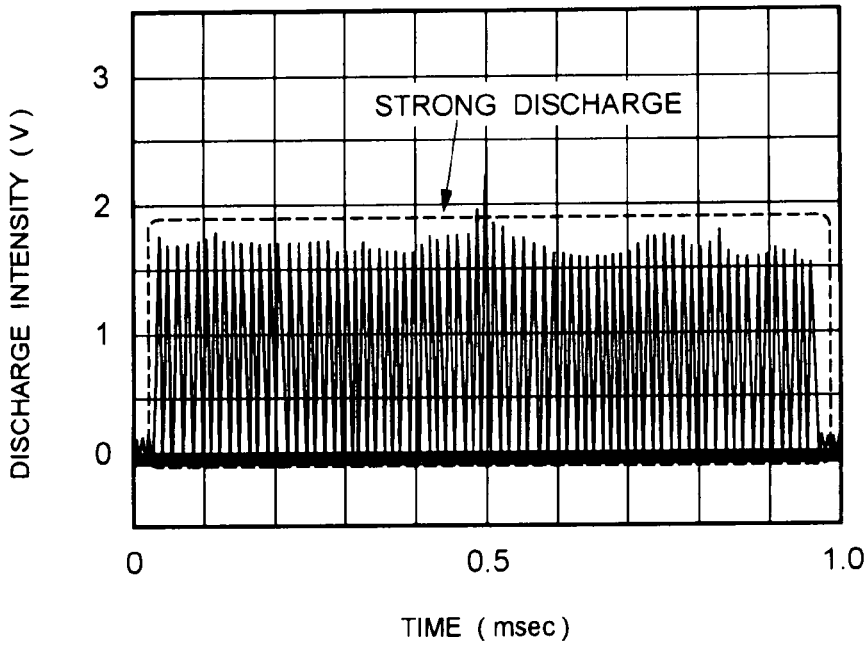
FIG. 9 is a diagram depicting the transition of discharge intensity in the column side cathode discharge which is generated when a reset pulse $RP_{Y1}$ is applied to a conventional PDP, where CL emission MgO crystalline is contained only in the magnesium oxide layer 13.

FIG. 9 is a diagram depicting a transition of the discharge intensity in the column side cathode discharge generated when the reset pulse $RP_{Y1}$ shown in FIG. 8 is applied to the PDP, where CL emission MgO crystallines are contained only in the magnesium oxide layer 13 out of the magnesium oxide layer 13 and the fluorescent layer 17.

Figure 10:
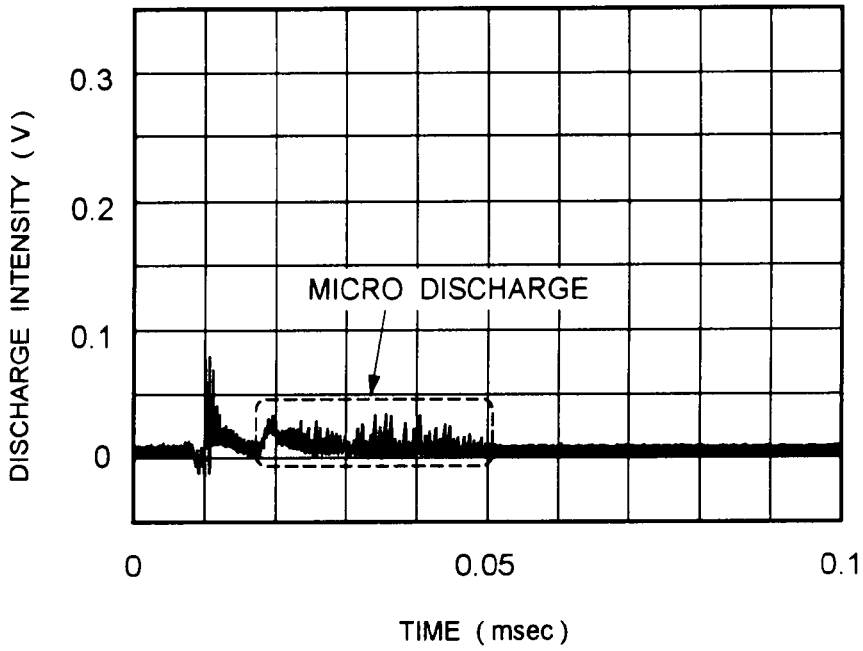
FIG. 10 is a diagram depicting the transition of discharge intensity in the column side cathode discharge which is generated when a reset pulse $RP_{Y1}$ is applied to a PDP 50, where CL emission MgO crystalline is contained in both the magnesium oxide layer 13 and the fluorescent layer 17.

FIG. 10, on the other hand, is a transition of the discharge intensity in the column side cathode discharge generated when the reset pulse $RP_{Y1}$ is applied to the PDP 50 according to the present embodiment, where the CL emission MgO crystallines are contained in both the magnesium oxide layer 13 and the fluorescent layer 17.

As FIG. 9 shows, according to the conventional PDP, a relatively strong column side cathode discharge continues 1 millisecond (ms) or longer as the reset pulse $RP_{Y1}$ is applied, but according to the PDP 50 of the present embodiment, the column side cathode discharge shown in FIG. 10 ends within about 0.04 ms. In other words, the discharge delay time in the column side cathode discharge can be decreased considerably compared with a conventional PDP.

Therefore as shown in FIG. 8, if the column side cathode discharge is generated by applying the reset pulse $RP_{Y1}$ having a waveform of which potential transition in the rise period is gentle to the row electrode Y of the PDP 50, the discharge ends before the potential of the row electrode Y reaches the peak potential of the pulse. Therefore the column side cathode discharge ends in a stage when the voltage applied between the row electrode and the column electrode is low, so, as shown in FIG. 10, the discharge intensity also drops considerably compared to the case of FIG. 9.

Figure 11:
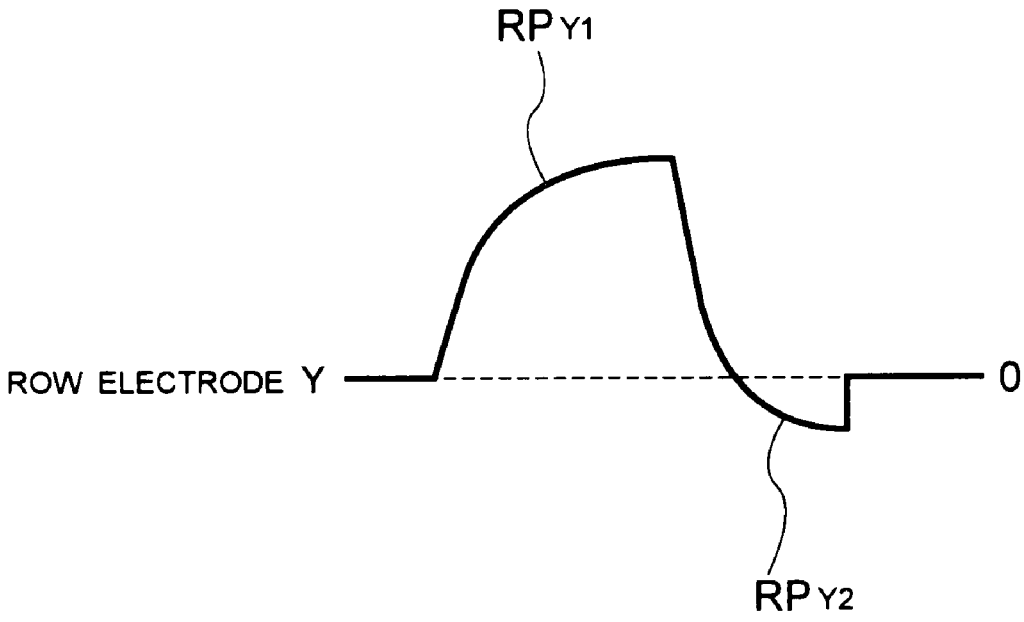
FIG. 11 is a diagram depicting another waveform of the reset pulse $RP_{Y1}$.

In other words, the column side cathode discharge of which discharge intensity is low is generated by applying the reset pulse $RP_{Y1}$, as shown in FIG. 8, having a waveform of which potential transition at the rising time is gentle, to the PDP 50 where CL emission MgO crystallines are contained in both the magnesium oxide layer 13 and the fluorescent layer 17. Since the column side cathode discharge, of which discharge intensity is extremely weak, can be generated as the reset discharge, contrast of the image, particularly the dark contrast when a dark image is displayed, can be increased. The waveform at the rise time in the reset pulse $RP_{Y1}$ is not limited to one having a predetermined inclination, as shown in FIG. 8, but may be one of which inclination gradually changes along with the lapse of time, as shown in FIG. 11, for example.

According to the driving shown in FIG. 8, in the sustain process I of the subfield SF1 of which brightness weight is smallest, the pixel cell PC in the ON mode is sustain-discharged only once by applying the sustain pulse IP only once. In other words, the brightness change in a low brightness image can be represented at high precision by creating a subfield for generating a sustain discharge once, which is the minimum number of times of discharge, in one field display period.

Also by driving for generating a sustain-discharge only once in the sustain process I of the subfield SF1, a discharge of which anode side is the column electrode D and the cathode side is the row electrode Y (hereafter called column side anode discharge) can be generated as the selective erase address discharge in the selective erase address process $W_D$ in SF2. In other words, in the sustain process I of the subfield SF1, the positive polarity sustain pulse IP is applied only once to only the row electrode Y out of the row electrodes X and Y, so after this one time sustain-discharge ends, negative polarity wall charges are formed near the row electrode Y, and positive polarity wall charges are formed near the column electrode D. Therefore in the selective erase address process $W_D$ of the next subfield SF2, the above mentioned column side anode discharge can be generated as the selective erase address discharge. In the sustain process I of each of the subsequent subfields SF2 to SF14, the number of times of applying the sustain pulse IP is an even number. Since negative polarity wall charges are formed near the row electrode Y and the positive polarity wall charges are formed near the column electrode D in the state immediately after each sustain process I, the column side anode discharge can also be generated in the respective selective erase address process $W_D$ of the subsequent subfields after SF2, just like the case of SF2. Therefore in all the subfields SF1 to SF14, the drive pulse (DP, HP) to be applied to the column electrode D all have positive polarity, so an increase in the cost of the address driver 55 can be suppressed compared with the case of requiring positive polarity and negative polarity drive pulses. The subfield SF2 does not have the reset process R, so the address process $W_D$ and the sustain process I of SF2 are executed immediately after the sustain process I of SF1. In this case, the number of times of a sustain discharge to be generated is low (only once) in the sustain process I of the subfield SF1, so the stored amount of charged particles which are generated in the pixel cell PC is also very small. Also during this time, an increase in charged particles by a reset discharge cannot be expected, so the intensity of a sustain discharge generated the first time in the sustain process I of the next subfield SF2 becomes weak, and the amount of charged particles stored in the pixel cell PC cannot reach a predetermined amount by the first sustain discharge. As a result, a second or later sustain discharges cannot be generated with certainty. Therefore in the sustain process I of the subfield SF2, the positive polarity auxiliary pulse HP is applied to the column electrode D, synchronizing with the sustain pulse IP to be applied to the row electrode X so as to generate the first sustain discharge as shown in FIG. 8. By applying this auxiliary pulse HP, an auxiliary discharge is generated between the row electrode Y and the column electrode D simultaneously with the sustain discharge generated between the row electrodes X and Y in the pixel cell PC. In other words, even if the amount of charged particles stored in the pixel cell PC is very little in the previous stage, a relatively strong discharge (sustain discharge+auxiliary discharge) is generated in the beginning of the sustain process I of the subfield SF2, and many charged particles are generated in the pixel cell PC accordingly. Because of this, the stored amount of the charged particles in the pixel cell PC can reach the predetermined amount in the stage immediately after the first sustain discharge, so the second or later sustain discharges (without an auxiliary discharge) can be generated without fail. In other words, by generating the above mentioned sustain discharge+auxiliary discharge, many charged particles are generated in the pixel cell PC, therefore even if the reset process R is not created at the beginning of SF2, the second or later sustain discharge can be generated without fail in the sustain process I of SF2.

Figure 12:
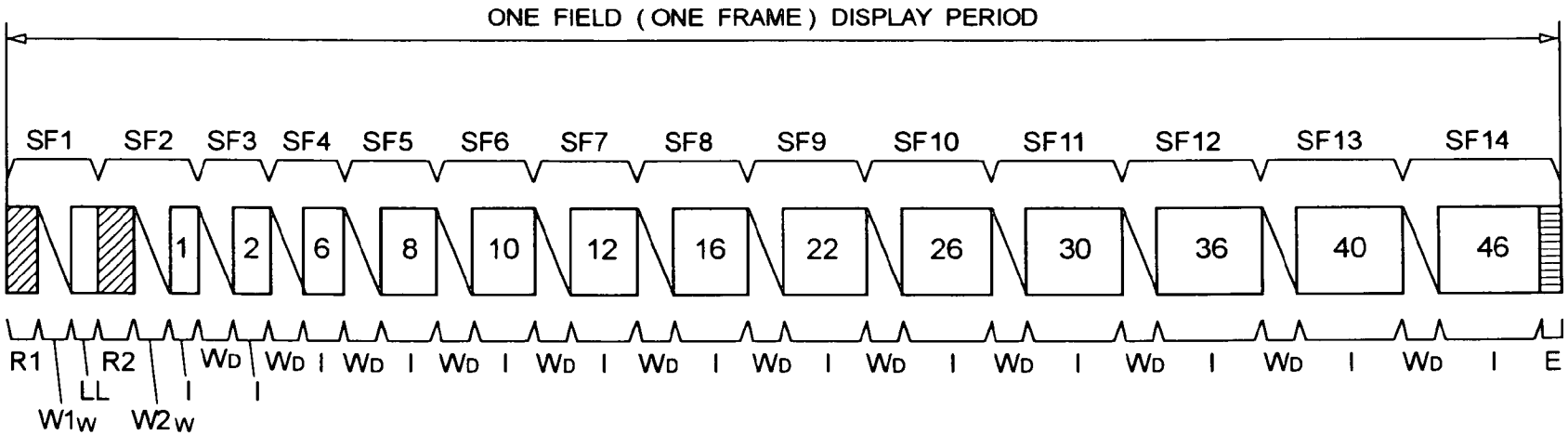
FIG. 12 is a diagram depicting another example of the emission drive sequence used for the plasma display device shown in FIG. 1.

When grayscale driving is performed for the PDP 50 using the above mentioned hybrid driving, driving according to the emission drive sequence shown in FIG. 12 may be executed instead of the emission drive sequence shown in FIG. 7.

In this case, in the first subfield SF1 of one field (one frame) display period, the drive control circuit 56 supplies various control signals for sequentially executing driving according to the first reset process R1, first selective write address process $W1_W$ and micro-emission process LL shown in FIG. 12, to the panel driver. In SF2 which follows subfield SF1, the drive control circuit 56 supplies various control signals for sequentially executing driving according to the second reset process R2, second selective write address process $W2_W$ and sustain process I, to the panel driver. In each subfield SF3 to SF14, the drive control circuit 56 supplies various control signals for sequentially executing driving according to the selective erase address process $W_D$ and sustain process I, to the panel driver. Only in the last subfield SF14 in one field display period, the drive control circuit 56 supplies various control signals for sequentially executing driving according to the erase process E, to the panel driver after executing the sustain process I. During this time, the drive control circuit 56 converts input video signals into 8-bit pixel data, for representing all the brightness levels in 256 grayscales, for each pixel, and performs error diffusion processing and dither processing for this pixel data to generate 4-bit multi-grayscale pixel data $PD_S$. Then the drive control circuit 56 converts the multi-grayscale pixel data $PD_S$ into 14-bit pixel drive data GD according to the data conversion table shown in FIG. 13. The drive control circuit 56 corresponds the first to fourteenth bits of pixel drive data GD to the subfields SF1 to SF14 (mentioned later) respectively, and supplies the bit digit corresponding to the subfield SF to the address driver 55 as the pixel drive data bit for one display line (m pixels) at a time.

Figure 14:
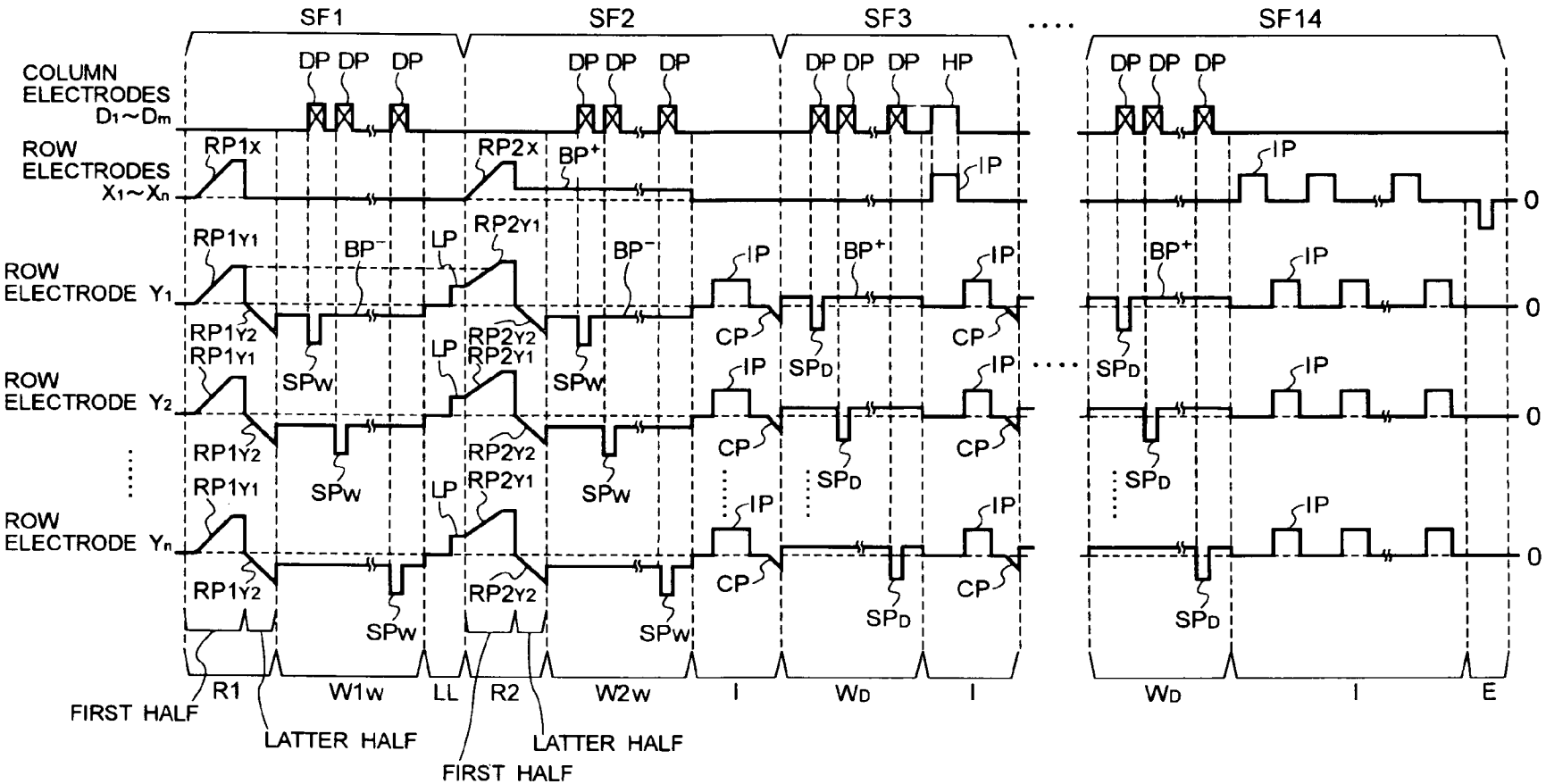
FIG. 14 is a diagram depicting various drive pulses applied to the PDP 50 according to the emission drive sequence shown in FIG. 12.

The panel driver, that is the X electrode driver 51, the Y electrode driver 53 and the address driver 55, generates various drive pulses shown in FIG. 14 according to various control signals supplied from the drive control circuit 56, and supplies them to the column electrodes D and row electrodes X and Y of the PDP 50.

FIG. 14 shows only the operation in SF1 to SF3 and the last subfield SF14 out of the subfields SF1 to SF14 shown in FIG. 12.

In the first half section of the first reset process R1 in the subfield SF1, the Y electrode driver 53 applies a positive polarity reset pulse $RP1_{Y1}$ having a waveform of which potential transition at the leading edge with the lapse of time is gentle, compared with the later mentioned sustain pulse, to all the row electrodes $Y_1$ to $Y_n$. The peak potential of the reset pulse $RP1_{Y1}$ is higher than the peak potential of the sustain pulse, and is lower than the peak potential of the later mentioned reset pulse $RP2_{Y1}$. During this time, the address driver 55 sets the column electrodes $D_m$ to $D_m$ to a ground potential (0 volts) state. Also during this time, the X electrode driver 51 applies the reset pulse $RP1_x$, which has the same polarity as the reset pulse $RP1_{Y1}$, and has a peak potential that can prevent surface discharge between the row electrodes X and Y due to applying the reset pulse $RP1_{Y1}$, to all the row electrodes $X_1$ to $X_n$ respectively. If a surface discharge is not generated between the row electrodes X and Y during this time, the X electrode driver 51 may set all the row electrodes $X_1$ to $X_n$ to ground potential (0 volts), instead of applying the reset pulse $RP1_x$. In this case, in the first half section of the first reset process R1, a weak first reset discharge is generated between the row electrode Y and the column electrode D in all the pixel cells PC respectively as the above mentioned reset pulse $RP1_{Y1}$ is applied. In other words, in the first half section of the first reset process R1, voltage is applied between the electrodes such that the anode side is the row electrode Y and the cathode side is the column electrode D, by which the column side cathode discharge for flowing current from the row electrode Y to the column electrode D is generated as the first reset discharge. By this first reset discharge, negative polarity wall charges are formed near the row electrode Y, and positive polarity wall charges are formed near the column electrode D in all the pixel cells PC.

In the latter half section of the first reset process R1 in the subfield SF1, the Y electrode driver 53 generates a negative polarity reset pulse $RP1_{Y2}$ of which potential transition at the leading edge with the lapse of time is gentle, and applies this to all the row electrodes $Y_1$ to $Y_n$. The negative peak potential of the reset pulse $RP1_{Y2}$ is set to a potential higher than the peak potential of the later mentioned negative polarity write scan pulse $SP_W$, that is a potential close to 0 volts. In other words, if the peak potential of the reset pulse $RP_{Y2}$ is lower than the peak potential of the write scan pulse $SP_W$, a strong discharge is generated between the row electrode Y and the column electrode D, and a large amount of wall charges formed near the column electrode D is erased, which makes address discharge unstable in the first selective write address process $W1_W$. During this time, the X electrode driver 51 sets all the row electrodes $X_1$ to $X_n$ to ground potential (O volts). The peak potential of the reset pulse $RP1_{Y2}$ is a minimum potential that can generate the second reset discharge between the row electrodes X and Y without fail, considering the wall charges formed near the row electrodes X and Y respectively according to the first reset discharge. In the latter half section of the first reset process R1, the second reset discharge is generated between the row electrodes X and Y in all the pixel cells PC as the above mentioned reset pulse $RP1_{Y2}$ is applied. By the second reset discharge, the wall charges formed near the row electrodes X and Y respectively in each pixel cell PC are erased, and all the pixel cells PC are initialized to OFF mode. Also as the reset pulse $RP1_{Y2}$ is applied, a weak discharge is generated between the row electrode Y and the column electrode D in all the pixel cells PC. By this weak discharge, a part of the positive polarity wall charges formed near the column electrode D is erased, and is adjusted to an amount which can generate a selective write address discharge correctly in the later mentioned first selective write address process $W1_W$.

In the first selective write address process $W1_W$ in the subfield SF1, the Y electrode driver 53 sequentially and alternately applies a write scan pulse $SP_W$ having a negative polarity peak potential to the row electrodes $Y_1$ to $Y_n$ respectively while simultaneously applying a base pulse BP− having a predetermined negative polarity base potential, as shown in FIG. 14, to the row electrodes $Y_1$ to $Y_n$. During this time, the address driver 55 converts the pixel drive data bit corresponding to subfield SF1 into a pixel data pulse DP having a pulse voltage according to the logic level thereof. For example, if the pixel drive data bit with logic level 1 for setting the pixel cell PC to ON mode is supplied, the address driver 55 converts this into the pixel data pulse DP having a positive polarity peak potential. For the pixel drive data bit with logic level 0 for setting the pixel cell PC to OFF mode, on the other hand, the address driver 55 converts this into low voltage (0 volts) data pulse DP. Then the address driver 55 applies this pixel data pulse DP to the column electrodes $D_1$ to $D_m$ synchronizing the application timing of each write scan pulse $SP_W$ for one display line (m pixels) at a time. In this case, at the same time with this write scan pulse $SP_W$, a selective write address discharge is generated between the column electrode D and the row electrode Y in the pixel cell PC where a high voltage pixel data pulse DP for setting the pixel cell to ON mode is applied. During this time, voltage according to the write scan pulse $SP_W$ is also applied between the row electrodes X and Y, but in this stage all the pixel cells PC are in OFF mode, that is in a state where the wall charges are erased, so a discharge is not generated between the row electrodes X and Y by applying this write scan pulse $SP_W$ alone. Therefore in the first selective write address process $W1_W$ in the subfield SF1, the selective write address discharge is generated only between the column electrode D and the row electrode Y in the pixel cell PC as the write scan pulse $SP_W$ and the high voltage pixel data pulse DP are applied. By this, the pixel cell PC is set to ON mode, where positive polarity wall charges are formed near the row electrode Y, and negative polarity wall charges are formed near the column electrode D respectively, even if wall charges do not exist near the row electrode X in the pixel cell PC. The selective write address discharge is not generated between the column electrode D and the row electrode Y of the pixel cell PC, where a low voltage (0 volts) pixel data pulse DP for setting the pixel cell to OFF mode is applied at the same time with the write scan pulse $SP_W$. Therefore this pixel cell PC maintains the state of OFF mode initialized in the first reset process R1, that is a state where a discharge is not generated between the row electrode Y and the column electrode D, or between the row electrodes X and Y.

Then in the micro-emission process LL in subfield SF1, the Y electrode driver 53 simultaneously applies the micro-emission pulse LP having a predetermined positive polarity peak potential, as shown in FIG. 14, to the row electrodes $Y_1$ to $Y_n$. As the micro-emission pulse LP is applied, a discharge is generated between the column electrode D and the row electrode Y in the pixel cell PC being set to ON mode (hereafter called micro-emission discharge). In other words, in the micro-emission process LL, a potential which generates a discharge between the row electrode Y and the column electrode D in the pixel cell PC, but which does not generate a discharge between the row electrodes X and Y, is applied to the row electrode Y, whereby the micro-emission discharge is generated only between the column electrode D and the row electrode Y in the pixel cell PC being set to ON mode. In this case, the peak potential of the micro-emission pulse LP is a potential lower than the peak potential of the sustain pulse IP which is applied in the later mentioned sustain process I in the subfield SF2 and later, such as potential the same as a base potential applied to the row electrode Y in the later mentioned selective erase address process $W_D$. Also as FIG. 14 shows, the change rate with the lapse of time in the rise period of the potential in the micro-emission pulse LP is higher than the change rate in the rise period of the reset pulse ($RP1_{Y1}$, $RP2_{Y1}$). In other words, the potential transition at the leading edge of the micro-emission pulse LP is set sharper than the potential transition at the leading edge of the reset pulse, so that a discharge stronger than the first reset discharge generated in the first reset process R1 and the second reset process R2 is generated. In this case, this discharge is the above mentioned column side cathode discharge, and is generated by the micro-emission pulse LP of which pulse voltage is lower than the sustain pulse IP, so the emission brightness, due to the discharge, is lower than the sustain discharge generated between the row electrodes X and Y. In other words, in the micro-emission process LL, a discharge which generates emission at a brightness level that is higher than the first reset discharge but is lower than the sustain discharge, that is a discharge which generates an emission small enough to be used for a display, is generated as the micro-emission discharge. In this case, in the first selective write address process $W1_W$ that is executed immediately before the micro-emission process LL, the selective write address discharge is generated between the column electrode D and the row electrode Y in the pixel cell PC. Therefore in subfield SF1, brightness corresponding to the grayscale that is 1 level higher than the brightness level 0 can be represented by the emission generated by the selective write address discharge and the emission generated by the micro-emission discharge.

After this micro-emission discharge, negative polarity wall charges are formed near the row electrode Y, and positive polarity wall charges are formed near the column electrode D respectively.

In the first half section of the second reset process R2 in the subfield SF2, the Y electrode driver 53 applies a positive polarity reset pulse $RP2_{Y1}$, having a waveform of which potential transition at the leading edge with the lapse of time, is gentle, compared with the later mentioned sustain pulse, to all the row electrodes $Y_1$ to $Y_n$. The peak potential of the reset pulse $RP2_{Y1}$ is higher than the peak potential of the reset pulse $RP1_{Y1}$. During this time, the address driver 55 sets the column electrodes $D_1$ to $D_m$ to a ground potential (0 volts) state, and the X electrode driver 51 applies the positive polarity reset pulse $RP2_x$ having a peak potential that can prevent a surface discharge between the row electrodes X and Y due to applying the reset pulse $RP2_{Y1}$, to all the row electrodes $X_1$ to $X_n$ respectively. If the surface discharge is not generated between the row electrodes X and Y, the X electrode driver 51 may set all the row electrodes X1 to Xn to the ground potential (0 volts), instead of applying the reset pulse $RP2_x$. As the reset pulse $RP2_{Y1}$ is applied, the first reset discharge, which is weaker than the column cathode discharge in micro-emission process LL, is generated between the row electrode Y and the column electrode D in the pixel cell PC where the column side cathode discharge was not generated in micro-emission process LL, out of each pixel cell PC. In other words, in the first half section of the second reset process R2, a voltage is applied between the electrodes such that the anode side is the row electrode Y, and the cathode side is the column electrode D, by which the column side cathode discharge for flowing current from the row electrode Y to the column electrode D is generated as the first reset discharge. In the pixel cell PC where a micro-emission discharge was already generated in the micro-emission process LL, on the other hand, a discharge is not generated even if the reset pulse $RP2_{Y1}$ is applied. Therefore when the first half section of the second reset process R2 ends, negative polarity wall charges are formed near the row electrode Y, and positive polarity wall charges are formed near the column electrode D in all the pixel cells PC.

In the latter half section of the second reset process R2 in the subfield SF2, the Y electrode driver 53 applies a negative polarity reset pulse $RP2_{Y2}$ of which potential transition at the leading edge with the lapse of time is gentle, to the row electrodes $Y_1$ to $Y_n$. In the latter half section of the second reset process R2, the X electrode driver 51 applies a base pulse BP+ having a predetermined positive polarity base potential to the row electrodes $X_1$ to $X_n$ respectively. As the negative polarity reset pulse $RP2_{Y2}$ and the positive polarity base pulse BP+ are applied, the second reset discharge is generated between the row electrodes X and Y in all the pixel cells PC. The respective peak potential of the reset pulse $RP2_{Y2}$ and the base pulse BP+ is a minimum potential that can generate the second reset discharge between the row electrodes X and Y without fail, considering the wall charges formed near the row electrodes X and Y respectively by the first reset discharge. The negative peak potential of the reset pulse $RP2_{Y2}$ is set to a potential higher than the peak potential of the negative polarity write scan pulse $SP_W$, that is a potential close to 0 volts. In other words, if the peak potential of the reset pulse $RP2_{Y2}$ is lower than the peak potential of the write scan pulse $SP_W$, a strong discharge is generated between the row electrode Y and the column electrode D, and a large amount of wall charges formed near the column electrode D is erased, which makes address discharge unstable in the second selective write address process $W2_W$. By the second reset discharge generated in the latter half section of the second reset process R2, the wall charges formed near the row electrodes X and Y respectively in each pixel cell PC are erased, and all the pixel cells PC are initialized to OFF mode. Also as the reset pulse $RP2_{Y2}$ is applied, a weak discharge is generated between the row electrode Y and the column electrode D in all the pixel cells PC, a part of the positive polarity wall charges formed near the column electrode D is erased by this discharge, and is adjusted to an amount which can generate a selective write address discharge correctly in the second selective write address process $W2_W$.

In the second selective write address process $W2_W$ in subfield SF2, the Y electrode driver 53 sequentially and alternately applies a write scan pulse $SP_W$ having a negative polarity peak potential to the row electrodes $Y_1$ to $Y_n$ respectively while simultaneously applying a base pulse BP− having a predetermined negative polarity base potential, as shown in FIG. 14, to the row electrodes $Y_1$ to $Y_n$. The X electrode driver 51 continuously applies the base pulse BP+, which was applied to the row electrodes $X_1$ to $X_n$ in the latter half section of the second reset process R2, to the row electrodes $X_1$ to $X_n$ in the second selective write address process $W2_W$. The respective potential of the base pulse BP− and the base pulse BP+ are set to be a potential such that the voltage between the row electrodes X and Y becomes lower than the discharge start voltage of the pixel cell PC in a period when the write scan pulse $SP_W$ is not applied. Also in the second selective write address process $W2_W$, the address driver 55 converts the pixel drive data bit corresponding to subfield SF2 into a pixel data pulse DP having a pulse voltage according to the logic level thereof. For example, if the pixel drive data bit with logic level 1 for setting the pixel cell PC to ON mode is supplied, the address driver 55 converts this into the pixel data pulse DP having a positive polarity peak potential. For the pixel drive data bit with logic level 0 for setting the pixel cell PC to OFF mode, on the other hand, the address driver 55 converts this into low voltage (0 volts) pixel data pulse DP. Then the address driver 55 applies this pixel data pulse DP to the column electrodes $D_1$ to $D_m$ synchronizing with the application timing of each write scan pulse $SP_W$ for one display line (m pixels) at a time. In this case, at the same time with this write scan pulse $SP_W$, a selective write address discharge is generated between the column electrode D and the row electrode Y in the pixel cell PC where a high voltage pixel data pulse DP for setting the pixel cell to ON is applied. Immediately after this selective write address discharge, a weak discharge is also generated between the row electrodes X and Y in the pixel cell PC. In other words, after the write scan pulse $SP_W$ is applied, voltage, according to the base pulse BP− and the base pulse BP+, is applied between the row electrodes X and Y, but this voltage is set to a voltage lower than the discharge start voltage of each pixel cell PC, so a discharge is not generated in the pixel cell PC by this voltage alone. If the selective write address discharge is generated, however, a discharge is generated between the row electrodes X and Y induced by this selective write address discharge, only by the voltage applied based on the base pulse BP− and the base pulse BP+. This discharge is not generated in the first selective write address process $W1_W$ where the base pulse BP+ is not applied to the row electrode X. By this discharge and selective write address discharge, the pixel cell PC is set to ON mode, where positive polarity wall charges are formed near the row electrode Y, negative polarity wall charges are formed near the row electrode X, and negative polarity wall charges are formed near the column electrode D respectively. The selective write address discharge is not generated between the column electrode D and the row electrode Y of the pixel cell PC, where a low voltage (0 volts) pixel data pulse DP for setting the pixel cell to OFF mode is applied at the same time with the write scan pulse $SP_W$, therefore a discharge is not generated between the row electrodes X and Y. As a consequence, this pixel cell PC maintains the previous state, that is, the state of OFF mode initialized in the second reset process R2.

Then in the sustain process I in subfield SF2, the Y electrode driver 53 generates a sustain pulse IP having a positive polarity peak potential only for one pulse, and simultaneously applies this to each of the row electrodes $Y_1$ to $Y_n$. During this time, the X electrode driver 51 sets the row electrodes $X_1$ to $X_n$ to ground potential (0 volts), and the address driver 55 sets the column electrodes $D_1$ to $D_m$ to a ground potential (0 volts) state. As the sustain pulse IP is applied, a sustain discharge is generated between the row electrodes X and Y in the pixel cell PC being set to ON mode. Along with this sustain discharge, light emitted from the fluorescent layer 17 is irradiated outside through the front transparent substrate 10, whereby one time of display emission is performed according to the brightness weight of subfield SF1. As this sustain pulse IP is applied, a discharge is also generated between the row electrode Y and the column electrode D of the pixel cell PC being set to ON mode. By this discharge and sustain discharge, negative polarity wall charges are formed near the row electrode Y, and positive polarity wall charges are formed near the row electrode X and column electrode D respectively in the pixel cell PC. After the sustain pulse IP is applied, the Y electrode driver 53 applies a wall charge adjustment pulse CP having a negative polarity peak potential, of which potential transition at the leading edge with the lapse of time is gentle, as shown in FIG. 14, to the row electrodes $Y_1$ to $Y_n$. As this wall charge adjustment pulse CP is applied, a weak erase discharge is generated in the pixel cell PC where the sustain discharge is generated, as mentioned above, and a part of the wall charges formed inside the pixel cell is erased. By this, the amount of wall charges inside the pixel cell PC is adjusted to the amount that can generate the selective erase address discharge correctly in the next selective erase address process $W_D$.

Then in the selective erase address process $W_0$ in each subfield SF3 to SF14, the Y electrode driver 53 sequentially and alternately applies the erase scan pulse $SP_D$ having a negative polarity peak potential, as shown in FIG. 14, to each row electrode $Y_1$ to $Y_n$ while applying the base pulse BP+ having a predetermined positive polarity base potential to the row electrodes $Y_1$ to $Y_n$ respectively. The peak potential of the base pulse BP+ is set to a potential that can prevent an incorrect discharge between the row electrodes X and Y when the selective erase address process $W_0$ is being executed. Also when the selective erase address process $W_0$ is being executed, the X electrode driver 51 sets each row electrode $X_1$ to $X_n$ to ground potential (0 volts). In this selective erase address process $W_0$, the address driver 55 converts the pixel drive data bit corresponding to the subfield SF into the pixel data pulse DP having a pulse voltage according to the logic level thereof. For example, if the pixel drive data bit with logic level 1 for shifting the pixel cell PC from ON mode to OFF mode is supplied, the address driver 55 converts this into the pixel data pulse DP having a positive polarity peak potential. If the pixel drive data bit with logic level 0 for maintaining the current state of the pixel cell PC is supplied, on the other hand, the address driver 55 converts this into the low voltage (0 volts) pixel data pulse DP. Then the address driver 55 applies this pixel data pulse DP to the column electrodes $D_1$ to $D_m$ synchronizing with the timing of applying each erase scan pulse $SP_D$ for one display line (m pixels) at a time. In this case, a selective erase address discharge is generated between the column electrode D and the row electrode Y in the pixel cell PC where the high voltage pixel data pulse DP is applied at the same time with the erase scan pulse $SP_D$. By this selective erase address discharge, this pixel cell PC is set to OFF mode, where positive polarity wall charges are formed near the row electrodes X and Y, and negative polarity wall charges are formed near the column electrode D. This selective erase address discharge is not generated between the column electrode D and the row electrode Y in a pixel cell PC where the low voltage (0 volts) pixel data pulse DP is applied at the same time with the erase scan pulse $SP_D$. Therefore this pixel cell PC maintains the previous state (ON mode, OFF mode).

In the sustain process I in each subfield SF3 to SF14, the X electrode driver 51 and the Y electrode driver 53 applies the sustain pulse IP having a positive polarity peak potential to each row electrode $X_1$ to $X_n$ and $Y_1$ to $Y_n$, (alternately to the row electrodes X and Y), repeatedly for the number of times (even number of times) corresponding to the brightness weight of the subfield as shown in FIG. 14. Each time this sustain pulse IP is applied, the sustain discharge is generated between the row electrodes X and Y in a pixel cell PC being set to ON mode. The light emitted from the fluorescent layer 17 is irradiated outside via the front transparent substrate 10 along with this sustain discharge, whereby the display emission is performed for a number of times according to the brightness weight of the subfield SF. In this case, negative polarity wall charges are formed near the row electrode Y, and positive polarity wall charges are formed near the row electrode X and the column electrode D respectively in the pixel cell PC where the sustain discharge is generated according to the sustain pulse IP applied last in each sustain process I in the subfields SF2 to SF14. After this last section pulse IP is applied, the Y electrode driver 53 applies the wall charge adjustment pulse CP having a negative polarity peak potential, of which potential transition at a leading edge with the lapse of time is gentle, as shown in FIG. 14, to the row electrodes $Y_1$ to $Y_n$. As this wall charge adjustment pulse CP is applied, a weak erase discharge is generated in the pixel cell PC where the above mentioned sustain discharge is generated, and a part of the wall charges formed inside the pixel cell is erased. By this, the amount of the wall charges in the pixel cell PC is adjusted to an amount that can generate the selective erase address discharge correctly in the next selective erase address process $W_D$.

In the sustain process I in SF3 of the subfields SF3 to SF14, the address driver 55 applies the auxiliary pulse HP having a positive polarity peak potential shown in FIG. 14 to the column electrodes $D_1$ to $D_m$ respectively, synchronizing only with the sustain pulse IP which is applied first in the sustain process I. In this case, the peak potential of the auxiliary pulse HP is the same as the peak potential of the pixel data pulse DP, and the pulse width thereof is the same as the pulse width of the sustain pulse IP applied the first time in the sustain process I of the subfield SF3. According to this auxiliary pulse HP, an auxiliary discharge is generated between the column electrode D and the row electrode Y in the pixel cell PC being set to ON mode. In other words, in the beginning of the sustain process I of the subfield SF3, a sustain discharge according to the first sustain pulse IP is generated between the row electrodes X and Y in the pixel cell PC being set to ON mode, and at the same time, an auxiliary discharge according to the auxiliary pulse HP is generated between the column electrode D and the row electrode Y. Therefore during this time, many charged particles are generated in the pixel cells PC compared with the case when only a sustain discharge is generated. By this, a second and later sustain discharges can be generated without fail. The discharge according to the auxiliary pulse HP is performed only once in the sustain process I, so power consumption due to this discharge is minimal.

After the sustain process I in the last subfield SF14 ends, the Y electrode driver 53 applies the erase pulse EP having a negative polarity peak potential to all the row electrodes $Y_1$ to $Y_n$. As this erase pulse EP is applied, an erase discharge is generated only in a pixel cell PC in ON mode. By this discharge, the pixel cell PC in ON mode shifts to OFF mode.

The above driving is executed based on 16 types of pixel drive data GD shown in FIG. 13.

First in the second grayscale which represents brightness only one level higher than the first grayscale which represents black display (brightness level 0), a selective write address discharge for setting the pixel cell PC to ON mode is generated only in SF1 out of the subfields SF1 to SF14, as shown in FIG. 13, and a micro-emission discharge is generated in the pixel cell PC being set to ON mode (indicated by a square). In this case, the brightness level during an emission generated by a selective write address discharge and micro-emission discharge is lower than the brightness level during emission generated by a one time sustain discharge. Therefore if the brightness level visually recognized by the sustain discharge is "1", the brightness corresponding to the brightness level "α", which is lower than the brightness level "1", is represented in the second grayscale.

In the third grayscale which represents brightness only one level higher than the second grayscale, a selective write address discharge is generated for setting the pixel cell PC to ON mode only by SF2 of subfields SF1 to SF14 (indicated by double circles), and a selective erase address discharge is generated in the subsequent subfield SF3 for shifting the pixel cells PC to OFF mode (indicated by black circle). Therefore in the third grayscale, emission is generated by a one time sustain discharge only in the sustain process I of SF2 of the subfields SF1 to SF14, and brightness corresponding to the brightness level "1" is represented.

In the fourth grayscale which represents brightness only one level higher than the third grayscale, a selective write address discharge is generated in the subfield SF1 for setting the pixel cells PC to ON mode, and a micro-emission discharge is generated in the pixel cells PC being set to ON mode (indicated by a square). Also in the fourth grayscale, a selective write address discharge is generated for setting the pixel cells PC to ON mode only in SF2 of the subfields SF1 to SF14 (indicated by double circles), and a selective erase address discharge is generated in the subsequent subfield SF3 for shifting the pixel cell PC to OFF mode (indicated by a black circle). Therefore in the fourth grayscale, an emission with brightness level "α" is performed in subfield SF1, and sustain discharge for generating an emission with brightness level "1" is performed only once in SF2, so brightness corresponding to the brightness level "α"+"1" is represented.

In the fifth grayscale to sixteenth grayscale, a selective write address discharge for setting the pixel cell PC to ON mode is generated in the subfield SF1, and a micro-emission discharge is generated in the pixel cells PC being set to ON mode (indicated by a square). Then a selective erase address discharge for shifting the pixel cells PC to OFF mode is generated only in one subfield corresponding to the grayscale (indicated by a black circle). Therefore in each of the fifth grayscale to sixteenth grayscale, a micro-emission discharge is generated in the subfield SF1, and a one time sustain discharge is generated in SF2, then a sustain discharge is generated for a number of times assigned to the subfield in each continuous subfield, of which number is the number corresponding to the grayscale (indicated by a circle). By this, in the fifth grayscale to sixteenth grayscale, brightness corresponding to "ƒ¿"+"total number of sustain discharges generated in one field (or one frame) display period" is visually recognized. In other words, according to the driving based on the first to sixteenth grayscales shown in FIG. 13, the brightness range of which brightness level is "0" to "255+α" can be represented by 16 levels. According to this driving, areas where emission patterns (ON state, OFF state) are inverted from each other do not coexist in one screen in one field display period, so a pseudo-contour generated in such a state can be prevented.

In the driving shown in FIG. 14, the first reset discharge is generated between the row electrode Y formed on the front transparent substrate 10 and the column electrode D formed on the rear substrate 14, as shown in FIG. 3. Therefore compared with the case of generating a reset discharge between the row electrodes X and Y formed on the front transparent substrate 10, a discharge light which is emitted outside from the front transparent substrate side 10 decreases, so dark contrast can be further improved.

Also in this driving, after the reset discharge for initializing all the pixel cells PC to OFF mode is generated in the first subfield SF1, the selective write address discharge for shifting the pixel cells PC in OFF mode to ON mode is generated. Then in one subfield out of the subsequent subfields SF3 to SF14 of SF2, the selective erase address discharge for shifting the pixel cells PC in ON mode to OFF mode, that is the selective erase address method, is executed. Therefore if a black display (brightness level 0) is performed by this driving according to the first grayscale shown in FIG. 13, a discharge generated through the one field display period is only the reset discharge in the first subfield SF1. Therefore compared with the case of generating the reset discharge for initializing all the pixel cells PC to ON mode in the subfield SF1, and then generating a selective erase address discharge for shifting this to OFF mode, the number of times of a discharge generated through one field display period decreases, so dark contrast can be improved.

In the case of the driving shown in FIG. 12 to FIG. 14, not a sustain discharge but a micro-emission discharge is generated as a discharge that contributes to the display image in the subfield SF1 of which brightness weight is the lowest. In this case, a micro-emission discharge is generated between the column electrode D and the row electrode Y, so the brightness level during emission generated by the discharge is low, compared with the sustain discharge generated between the row electrodes X and Y. Therefore if brightness only one level higher than the black display (brightness level 0) is represented by this micro-emission discharge (second grayscale), the brightness difference from the brightness level 0 is smaller compared with the case of representing this by a sustain discharge. As a consequence, the grayscale representation capability for representing a low brightness image increases. In the second grayscale, a reset discharge is not generated in the second reset process R2 of the SF2 that follows the subfield SF1, so a drop in dark contrast due to this reset discharge can be suppressed.

According to the driving shown in FIG. 14, the peak potential of the reset pulse $RP1_{Y1}$, which is applied to the row electrode Y for generating the first reset discharge in the first reset process R1 of the subfield SF1, is lower than the peak potential of the reset pulse $RP2_{Y1}$, which is applied to the row electrode Y for generating the first reset discharge in the second reset process R2 of SF2. By this, in the first reset process R1 of the subfield SF1, the emission when a reset discharge is generated in all the pixel cells PC all at once is weakened so as to suppress a drop in dark contrast.

According to the driving shown in FIG. 12 and FIG. 13, a voltage of which cathode side is the column electrode D and anode side is the row electrode Y is applied between the electrodes in the first reset process R1 of the subfield SF1 and the second reset process R2 of the subfield SF2 respectively, whereby the column side cathode discharge for flowing current from the row electrode Y to the column electrode D is generated as the first reset discharge. Therefore when this first reset discharge is generated, cations in the discharge gas collide with the MgO crystallines as the secondary electron emission material contained in the fluorescent material layer 17 shown in FIG. 5 when cations move to the column electrode D, and secondary electrons are emitted from the MgO crystallines. Particularly in the PDP 50 of the plasma display device shown in FIG. 1, the probability of collision with cations is increased by exposing MgO crystallines to the discharge space, as shown in FIG. 5, so that the secondary electrons are emitted into the discharge space efficiently. Then the discharge start voltage of the pixel cells PC decreases by the priming function of the secondary electrons, so a relatively weak reset discharge can be generated. The reset discharge can be further weakened by partially containing CL emission MgO crystallines as MgO crystallines. Since the emission brightness generated by the discharge decreases due to the weakening of the reset discharge, contrast when a dark image is displayed, that is dark contrast, can be improved in the display.

Also according to the driving shown in FIG. 14, in the sustain process I of the subfield (SF2) of which brightness weight is lowest, a sustain discharge is generated only once in the pixel cells PC in ON mode by applying sustain pulse IP only once, just like the driving shown in FIG. 8. In other words, by creating in one field display period a subfield for generating a sustain discharge only once, which is the minimum discharge count, a brightness change in the low brightness image is represented with high resolution. In this case, by driving for generating a sustain-discharge only once in the sustain process I of the subfield SF2, a column side anode discharge, of which anode side is the column electrode D and the cathode side is the row electrode Y, can be generated as the selective erase address discharge in the selective erase address process $W_D$ in SF3. In the sustain process I in the subsequent subfields SF3 to SF14, the number of times of applying the sustain pulse IP is an even number. Therefore in the state immediately after each sustain process I ends, negative polarity wall charges are formed near the row electrode Y, and positive polarity wall charges are formed near the column electrode D, so a column side anode discharge, the same as SF3, can also be performed in the selective erase address process $W_D$ of each subfield that follows SF3. Therefore throughout the subfields SF1 to SF14, the drive pulses (DP, HP) to be applied to the column electrode D all have positive polarity, so compared with the case of requiring both positive polarity and negative polarity drive pulses, an increase in the cost of the address driver 55 can be suppressed. In the case of the driving shown in FIG. 14, the reset process R1 (or R2) is not created in the subfield SF3, so the address process $W_D$ and the sustain process I of SF3 are immediately executed after the sustain process I of SF2 ends. In this process, the number of times of sustain discharge to be generated is low (only once) in the sustain process I in the subfield SF2, so the stored amount of charged particles which are generated in the pixel cell PC by this discharge is also very small. Also during this time, an increase of charged particles by a reset discharge cannot be expected, so the intensity of a sustain discharge generated the first time in the sustain process I of the next subfield SF3 becomes weak, and the amount of charged particles stored in the pixel cell PC cannot reach a predetermined amount by this first sustain discharge. As a result, the second or later sustain discharges cannot be generated with certainty. Therefore in the sustain process I of the subfield SF3, the positive polarity auxiliary pulse HP is applied to the column electrode D, synchronizing with the sustain pulse IP to be applied to the row electrode X so as to generate the first sustain discharge, as shown in FIG. 14. By applying this auxiliary pulse HP, an auxiliary discharge is generated between the row electrode Y and the column electrode D simultaneously with the sustain discharge generated between the row electrodes X and Y in the pixel cell PC. In other words, even if the amount of charged particles stored in the pixel cell PC is very little in the previous stage, a relatively strong discharge (sustain discharge+auxiliary discharge) is generated in the beginning of the sustain process I of the subfield SF2, and many charged particles are generated in the pixel cell PC accordingly. Because of this, the stored amount of the charged particles in the pixel cell PC can reach a predetermined amount in the stage immediately after the first sustain discharge, so the second or later sustain discharges (without an auxiliary discharge) can be generated without fail. In other words, by generating the above mentioned sustain discharge+auxiliary discharge, many charged particles are generated in the pixel cell PC, therefore even if the reset process R1 (or R2) is not created at the beginning of SF3, the second or later sustain discharges can be generated without fail in the sustain process I of SF3.

As described above, in the method for driving a PDP according to the present invention, driving where a subfield, including the selective write address process ($W_W$, $W1_W$, $W2_W$), and a subfield, including the selective erase address process ($W_D$) coexist in one field display period (hereafter called hybrid driving), is executed for the PDP 50. A number of times of sustain discharge to be generated in the sustain process I, which is immediately after the selective write address process ($W_W$, $W1_W$, $W2_W$) and immediately before the selective erase address process ($W_D$), is once. Because of this, a brightness change in the low brightness image can be represented at high resolution, and the polarities of the drive pulses to be applied to the column electrodes are unified (only positive polarity) so as to decrease the cost of the driver.

Also according to the present invention, in order to compensate for the insufficiency of charged particles in the above mentioned sustain process I, where a sustain discharge is generated only once, an auxiliary pulse HP is applied to all the column-electrodes D synchronizing with the first sustain pulse IP in the subsequent sustain process I (SF2). By this a discharge is generated not only between the row electrodes X and Y in the pixel cell PC, but also between the row electrode Y and the column electrode D, so as to increase the charged particles.

Therefore according to the present invention, a sustain discharge can be generated without fail without increasing the pulse width of the sustain pulse, or the pulse voltage thereof, so the scale of the driver of the PDP can be decreased.

In the present embodiment, only one subfield, where the auxiliary pulse HP is applied to the column electrode D synchronizing with the sustain pulse IP to be applied first, is created in one field display period, but a plurality of subfields may be created. In other words, at least one subfield, where the auxiliary pulse HP is applied to the column electrode D simultaneously with the sustain pulse IP to be applied first in the sustain process I, is created in one field (or one frame) display period.

In the reset process R shown in FIG. 8 and FIG. 14, a reset discharge is generated in all the pixel cells all at once, but a reset discharge may be performed at different times for each pixel cell block comprised of a plurality of pixel cells.

In the driving shown in FIG. 13, a micro-emission discharge, which performs emission at brightness level α, is also generated in the subfield SF1 for the fourth or later grayscales, but this micro-emission discharge may not be generated for the third or later grayscales. In other words, since the brightness of emission performed by the micro-emission discharge is extremely low (brightness level a), when a sustain discharge performing a higher brightness emission is used together, that is in the case when a brightness increase of "brightness level α" is not visually recognized in the third or later grayscales, it is not necessary to generate a micro-emission discharge.

This application is based on Japanese Patent Application No. 2006-268145 which is hereby incorporated by reference.

What is claimed is:

1. A method for driving a plasma display panel in which a first substrate and a second substrate are positioned facing each other sandwiching a discharge space in which discharge gas is sealed, and a pixel cell including a fluorescent layer is formed at each intersection of a plurality of row electrode pairs formed on said first substrate and a plurality of column electrodes formed on said second substrate, by dividing one field display period of a video signal into a plurality of subfields and driving each subfield independently, wherein said one field display period has:

a plurality of subfields, each of which executes an address process for setting said pixel cells to ON mode or OFF mode by address-discharging said pixel cells selectively according to a pixel data of each pixel based on a video signal, and a sustain process for repeatedly sustain-discharging only said pixel cells being set to said ON mode for a number of times assigned corresponding to a brightness weight of said subfield by sequentially applying a sustain pulse to one row electrode of said row electrode pair and to the other row electrode alternately for said number of times; and a subfield for executing a reset process for initializing each of said pixel cells to one state out of said OFF mode and said ON mode by reset-discharging each of said pixel cells, in addition to said address process and said sustain process, and in said one field display period, an auxiliary pulse is applied to said column electrode only while a first sustain pulse is being applied in said sustain process of at least one subfield out of the subfields in which said reset process is not executed.

2. The method for driving a plasma display panel according to claim 1, wherein a number of times equal to or less than a predetermined value (positive integer) is assigned to said sustain process of the previous subfield of said one subfield as said number of times, and a number of times greater than said predetermined value is assigned to said sustain process of each of the other subfields as said number of times.

3. The method for driving a plasma display panel according to claim 2, wherein said predetermined value is 1.

4. The method for driving a plasma display panel according to claim 3, wherein said first sustain pulse is applied to said other row electrode, and said sustain pulse is applied to said one row electrode in said sustain process of said previous subfield.

5. The method for driving a plasma display panel according to claim 2, wherein in said address process of said previous subfield, said pixel cells are set to said ON mode according to said address discharge, and in said address process of said one subfield, said pixel cells are set to said OFF mode according to said address discharge.

6. The method for driving a plasma display panel according to claim 2, wherein said reset process is executed immediately before said address process in said previous subfield, and in said reset process, voltage of which anode side is one row electrode of said row electrode pair and cathode side is said column electrode is applied between said one row electrode and said column electrode, thereby a reset discharge is generated between said one row electrode and said column electrode in said pixel cells, and said pixel cells are initialized to said OFF mode respectively.

7. The method for driving a plasma display panel according to claim 2, wherein said previous subfield is disposed immediately after a first subfield of said one field display period, in said first subfield and said previous subfield, said reset process is executed immediately before said address process, in said reset process, voltage of which anode side is one row electrode of said row electrode pair and cathode side is said column electrode is applied between said one row electrode and said column electrode, thereby a reset discharge is generated between said one row electrode and said column electrode in said pixel cells, and said pixel cells are initialized to said OFF mode respectively, and in said first subfield, voltage of which anode side is one row electrode of said row electrode pair and cathode side is said column electrode is applied between one row electrode and said column electrode immediately after said address process, thereby a micro emission process for generating a micro emission discharge between said column electrode and said one row electrode in the pixel cells being set to said ON mode, is executed.

8. The method for driving a plasma display panel according to claim 7, wherein said micro emission discharge generates an emission corresponding to a grayscale of which brightness is one level higher than brightness level 0.

9. The method for driving a plasma display panel according to claim 1, wherein said fluorescent layer is a mixture of fluorescent material particles and secondary electron emission material.

10. The method for driving a plasma display panel according to claim 9, wherein said secondary electron emission material comprises magnesium oxide.

11. The method for driving a plasma display panel according to claim 10, wherein said magnesium oxide contains a magnesium oxide crystalline which is excited by an electron beam and performs cathode luminescence emission of which peak is within wavelength band 200 to 300 nm.

12. The method for driving a plasma display panel according to claim 11, wherein said magnesium oxide crystalline is a single crystalline of magnesium oxide generated by a vapor phase oxidation method.

13. The method for driving a plasma display panel according to claim 11, wherein said magnesium oxide crystalline performs cathode luminescence emission of which peak is within 230 to 250 nm.

14. The method for driving a plasma display panel according to claim 9, wherein particles formed of said secondary electron emission material contact said discharge gas in said discharge space.

15. A method for driving a plasma display panel in which a first substrate and a second substrate are positioned facing each other sandwiching a discharge space in which discharge gas is sealed, and a pixel cell including a fluorescent layer is formed at each intersection of a plurality of row electrode pairs formed on said first substrate and a plurality of column electrodes formed on said second substrate, by dividing one field display period of a video signal into a plurality of subfields and driving each subfield independently, wherein said one field display period has:

a plurality of subfields, each of which executes an address process for applying pixel data pulses to said column electrodes according to a pixel data of each pixel based on a video signal, and a sustain process for sequentially applying a sustain pulse to one row electrode of said row electrode pair and to the other row electrode alternately for a number of times assigned corresponding to a brightness weight of said subfield; and a subfield for executing a reset process for initializing each of said pixel cells, in addition to said address process and said sustain process, and wherein in said one field display period, when executing said sustain process in at least one of said plurality of subfields excluding said subfield which executes said reset process, a potential on said column electrodes during the application of a first one of said sustain pulses is made hither than a potential on said column electrodes in a period in which a subsequent sustain pulse is applied.

16. The method for driving a plasma display panel according to claim 15, wherein a number of times equal to or less than a predetermined value (positive integer) is assigned to said sustain process of the previous subfield of said one subfield as said number of times, and a number of times greater than said predetermined value is assigned to said sustain process of each of the other subfields as said number of times.

17. The method for driving a plasma display panel according to claim 16, wherein said predetermined value is 1.

18. The method for driving a plasma display panel according to claim 17, wherein said first sustain pulse is applied to said other row electrode, and said sustain pulse is applied to said one row electrode in said sustain process of said previous subfield.

19. The method for driving a plasma display panel according to claim 16, wherein in said address process of said previous subfield, said pixel cells are set to said ON mode according to said address discharge, and in said address process of said one subfield, said pixel cells are set to said OFF mode according to said address discharge.

20. The method for driving a plasma display panel according to claim 16, wherein said reset process is executed immediately before said address process in said previous subfield, and in said reset process, voltage of which anode side is one row electrode of said row electrode pair and cathode side is said column electrode is applied between said one row electrode and said column electrode, thereby a reset discharge is generated between said one row electrode and said column electrode in said pixel cells, and said pixel cells are initialized to said OFF mode respectively.

21. The method for driving a plasma display panel according to claim 16, wherein said previous subfield is disposed immediately after a first subfield of said one field display period, in said first subfield and said previous subfield, said reset process is executed immediately before said address process, in said reset process, voltage of which anode side is one row electrode of said row electrode pair and cathode side is said column electrode is applied between said one row electrode and said column electrode, thereby a reset discharge is generated between said one row electrode and said column electrode in said pixel cells, and said pixel cells are initialized to said OFF mode respectively, and in said first subfield, voltage of which anode side is one row electrode of said row electrode pair and cathode side is said column electrode is applied between one row electrode and said column electrode immediately after said address process, thereby a micro emission process for generating a micro emission discharge between said column electrode and said one row electrode in the pixel cells being set to said ON mode, is executed.

22. The method for driving a plasma display panel according to claim 21, wherein said micro emission discharge generates an emission corresponding to a grayscale of which brightness is one level higher than brightness level 0.

* * * * *